US012473918B2

(12) United States Patent
Park et al.

(10) Patent No.: US 12,473,918 B2
(45) Date of Patent: Nov. 18, 2025

(54) SCROLL COMPRESSOR

(71) Applicant: LG ELECTRONICS INC., Seoul (KR)

(72) Inventors: Sangbaek Park, Seoul (KR); Nayoung Jeon, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/842,136

(22) PCT Filed: Jan. 2, 2023

(86) PCT No.: PCT/KR2023/000048
§ 371 (c)(1),
(2) Date: Aug. 28, 2024

(87) PCT Pub. No.: WO2023/167401
PCT Pub. Date: Sep. 7, 2023

(65) Prior Publication Data

US 2025/0180017 A1 Jun. 5, 2025

(30) Foreign Application Priority Data

Mar. 3, 2022 (KR) ..... 10-2022-0027605

(51) Int. Cl.
*F04C 18/02* (2006.01)
*F04C 28/24* (2006.01)

(52) U.S. Cl.
CPC ..... *F04C 18/0215* (2013.01); *F04C 28/24* (2013.01); *F04C 2240/30* (2013.01)

(58) Field of Classification Search
CPC ... F04C 18/0215; F04C 28/24; F04C 2240/30
See application file for complete search history.

(56) References Cited

U.S. PATENT DOCUMENTS 4,216,661 A * 8/1980 Tojo ..... F04C 29/045 62/505
4,560,330 A * 12/1985 Murayama ..... F04C 18/0215 417/310

(Continued)

FOREIGN PATENT DOCUMENTS

CN 104047848 9/2014
JP 02-264177 10/1990

(Continued)

OTHER PUBLICATIONS

International Search Report dated Jun. 8, 2023 issued in Application No. PCT/KR2023/000048.

*Primary Examiner* — Anthony Ayala Delgado
(74) *Attorney, Agent, or Firm* — KED & ASSOCIATES

(57) ABSTRACT

A scroll compressor including a casing forming the exterior; a driving unit installed in the casing and generates a drive power; a rotary shaft installed in the driving unit to be rotatable; a compression portion including an orbiting scroll installed on the rotary shaft to be capable of orbiting, and a fixed scroll which is coupled to be engaged with the orbiting scroll so as to form a compression chamber between the orbiting scroll and the fixed scroll; and a check valve including a valve portion which is arranged so that one side thereof faces the compression chamber and guides suction of a refrigerant when being opened and is closed when the driving of the compressor is stopped so as to prevent the refrigerant from flowing backward, and a valve fixing portion which is installed on the side surface provided in the suction port of the fixed scroll.

12 Claims, 11 Drawing Sheets

(56) References Cited

U.S. PATENT DOCUMENTS

| | | | | |
|---|---|---|---|---|
| 5,496,160 | A * | 3/1996 | Richardson, Jr. ..... | F04C 29/124<br>137/527 |
| 6,336,797 | B1 * | 1/2002 | Kazakis ..... | F01C 17/063<br>418/270 |
| 9,482,229 | B2 * | 11/2016 | Adaniya ..... | F04C 28/28 |

FOREIGN PATENT DOCUMENTS

| | | |
|---|---|---|
| JP | 2009-235917 | 10/2009 |
| KR | 10-0156374 | 1/1999 |
| KR | 10-2020-0054784 | 5/2020 |

* cited by examiner

SCROLL COMPRESSOR

CROSS-REFERENCE TO RELATED PATENT APPLICATIONS

This application is a U.S. National Stage Application under 35 U.S.C. § 371 of PCT Application No. PCT/KR2023/000048, filed Jan. 2, 2023, which claims priority to Korean Patent Application No. 10-2022-0027605, filed Mar. 3, 2022, whose entire disclosures are hereby incorporated by reference.

TECHNICAL FIELD

The present disclosure relates to a scroll compressor.

BACKGROUND ART

In general, a compressor is applied to a vapor compression type refrigeration cycle (hereinafter, simply referred to as a refrigeration cycle), such as a refrigerator or an air-conditioner. Compressors may be classified into a reciprocal type, a rotary type, a scroll type, and the like according to a method of compressing refrigerant.

Among those compressors, a reciprocal compressor is a compressor in which gas is compressed by a reciprocating motion of a piston within a cylinder, and a scroll compressor is compressor in which a compression chamber is formed between a fixed wrap of a fixed scroll and an orbiting wrap of an orbiting scroll as the orbiting scroll engaged with the fixed scroll, fixed to an inner space of a hermetic case, performs an orbiting motion.

A scroll compressor is configured such that an orbiting scroll and a non-orbiting scroll are engaged with each other and a pair of compression chambers is formed while the orbiting scroll performs an orbiting motion with respect to the non-orbiting scroll.

The compression chamber includes a suction pressure chamber formed at an outer side, an intermediate pressure chamber continuously formed toward a central portion from the suction pressure chamber while gradually decreasing in volume, and a discharge pressure chamber connected to the center of the intermediate pressure chamber. Typically, the suction pressure chamber is formed through a side surface of the non-orbiting scroll, the intermediate pressure chamber is sealed, and the discharge pressure chamber is formed through an end plate of the non-orbiting scroll.

Scroll compressors may be classified into a low-pressure type and a high-pressure type according to a path through which refrigerant is suctioned. The low-pressure type is configured such that refrigerant suction pipe is connected to an inner space of a casing to guide suction refrigerant of low temperature to flow into a suction pressure chamber via the inner space of the casing. On the other hand, the high-pressure type is configured such that the refrigerant suction pipe is connected directly to the suction pressure chamber to guide refrigerant to flow directly into the suction pressure chamber without passing through the inner space of the casing.

The related art scroll compressors have two problems that occur due to a pressure difference between a suction part and a discharge part when the compressor stops operating.

First, in the scroll compressor, when the compressor stops operating, high-pressure refrigerant and oil in a discharge space move to the suction part, and when the compressor starts operating again, the oil and refrigerant that were stagnant in the suction part flow into a compression chamber.

Due to this, overcompression occurs in the compression unit due to the inflow of oil, a wrap may be cracked or broken, and the efficiency of the compressor is lowered.

As such, there was a problem that efficiency and reliability were deteriorated when the compressor was restarted after stopped.

Secondly, in the related art scroll compressor, when the compressor stops operating, a discharge space forms high pressure and a suction space forms low pressure.

This causes an orbiting scroll to rotate in reverse, and generates noise.

Patent Document 1 (Patent Publication No. 10-2020-0054784 (May 20, 2020)) discloses a scroll compressor including: a case; a drive motor including a stator mounted inside the case and a rotor rotatably disposed radially inside the stator; a centrifugal separation space that is defined by one side (downstream side) of the drive motor and the case inside the case, and in which centrifugal separation of compressed refrigerant and lubricating oil is performed; a discharge pipe disposed in the case and discharging refrigerant in the centrifugal separation space to outside; a rotary shaft coupled to the rotor to be rotatable; a compression unit including an orbiting scroll disposed on another side (upstream side) of the drive motor to be rotatable by the rotation of the rotary shaft, and a fixed scroll for compressing refrigerant together with the orbiting scroll; and a check valve installed inside a refrigerant suction port of the compression unit through a side surface of the fixed scroll.

Patent Document 1 discloses a scroll compressor having a structure including a check valve to solve problems of the related art scroll compressor caused by a pressure difference between a suction part and a discharge part after the compressor stops, namely, a problem of deterioration of efficiency and reliability when the compressor is restarted after stopped, and a problem of noise generation due to reverse rotation of an orbiting scroll.

However, there is a problem that the scroll compressor of Patent Document 1 is difficult to be applied to mass production.

In more detail, the assembly of the suction part of the scroll compressor is carried out in the order of press-fitting an inlet tube into a shell of a collar, welding a suction tube, and welding a suction pipe.

However, in order to apply a suction pipe structure proposed in Patent Document 1, an additional adapter configuration was required on the exterior of the shell of the compressor, and additional machining processes such as coupling the adapter in a welding manner, forming only a partial section of the shell to be thicker, or the like were required.

In addition, in order to apply the suction pipe structure proposed in Patent Document 1, installation of an O-ring was also required, which caused an increase in manufacturing cost and the number of processes.

Meanwhile, if the suction pipe structure of Patent Document 1 is directly press-fitted in a collar shape, there is a concern that a valve may be deformed during the press-fitting of the collar or welding of an external pipe, thereby losing its sealing function.

Therefore, there is a need for the development of a structure that can suppress loss of a sealing function due to deformation caused by welding without increasing additional machining processes or manufacturing costs and the number of processes.

DISCLOSURE OF INVENTION

Technical Problem

The present disclosure has been invented to solve the above problems, and a first aspect of the present disclosure is to provide a scroll compressor that is capable of employing a check valve, to which a hinge structure is applied, while maintaining an existing structure of a shell that can be mass-produced.

In addition, a second aspect of the present disclosure is to provide a scroll compressor having a structure that is capable of suppressing efficiency and reliability from being lowered even when the compressor is restarted after stopped.

In addition, a third aspect of the present disclosure is to provide a scroll compressor having a structure that is capable of suppressing noise generation due to reverse rotation of an orbiting scroll when the compressor is restarted after stopped.

In addition, a fourth aspect of the present disclosure is to provide a scroll compressor having a structure that is capable of suppressing refrigerant and oil from flowing back toward a suction side when the compressor is stopped.

Solution to Problem

To achieve these and other advantages and in accordance with the purpose of the present disclosure, as embodied and broadly described herein, there is provided a scroll compressor including: a casing that defines appearance; a driving unit that is installed inside the casing to generate driving force; a rotary shaft that is rotatably installed in the driving unit; a compression unit that includes an orbiting scroll installed on the rotary shaft to perform an orbital motion, and a fixed scroll engaged with the orbiting scroll to form a compression chamber together with the orbiting scroll; and a check valve that includes a valve part having one side disposed to face the compression chamber to guide suction of refrigerant when being open and suppress backflow of refrigerant by being closed when an operation of the compressor is stopped, and a valve fixing part installed through a side surface disposed on a suction port of the fixed scroll.

Due to this, the valve fixing part of the check valve can be installed directly through the side surface disposed on the suction port of the fixed scroll, such that the check valve can be simply assembled to the fixed scroll without a change of a complicated structure.

According to one example related to the present disclosure, the valve fixing part is screw-coupled to the side surface disposed on the suction port of the fixed scroll.

Due to this, the valve fixing part of the check valve can be screw-coupled to the side surface disposed on the suction port of the fixed scroll, such that the check valve can be simply assembled to the fixed scroll without a change of a complicated structure.

To this end, the valve fixing part may include a screw portion formed to extend spirally in a circumferential direction, and a screw coupling portion may be formed on the side surface disposed on the suction port of the fixed scroll and may have a screw thread extending in a spiral shape to be screw-coupled with the screw portion.

The valve part may include: a valve body having one side inserted into the valve fixing part and including a refrigerant flow passage through which refrigerant flows; and a plate member having a rotating portion on one side adjacent to the compression chamber to be rotatably connected to the valve body, the plate member being open when refrigerant is introduced and closed when the operation of the compressor is stopped to suppress the backflow of the refrigerant.

The valve body may include a rotation-limiting end portion that is disposed on one surface facing the compression chamber and supports the plate member while limiting rotation of the plate member in one direction, to suppress the backflow of the refrigerant.

With this structure, in the scroll compressor according to the present disclosure, refrigerant flows through the suction port when the compressor is in operation, and when the compressor is stopped, a hinge part is rotated and closed due to a difference between high pressure inside a compression unit and low pressure in a suction part, thereby blocking the high pressure and the low pressure from each other.

The plate member may be disposed, in an open state, such that an inner surface thereof is disposed to face a flowing direction of refrigerant in the compression chamber, to guide an introduction of the refrigerant into the compression chamber.

In the present disclosure, a plate member receiving groove may be formed in the suction port of the fixed scroll to rotatably receive the plate member, and the plate member receiving groove may be formed from one side portion of the compression chamber to another side portion of the compression chamber along a path along which the plate member rotates.

The plate member receiving groove may be formed in the suction port of the fixed scroll from one side to another side of the compression chamber along the path along which the plate member rotates. Accordingly, the plate member can smoothly rotate in the suction port of the fixed scroll.

The valve body may include an opening direction maintenance portion formed by cutting one side of an outer circumference into a D-cut shape to maintain an opening direction of the plate member, and a guide groove may be formed in a side portion of the fixed scroll to be engaged with the opening direction maintenance portion to maintain the opening direction of the plate member.

Accordingly, since the valve body does not rotate during an assembly or compression process, the opening direction of the plate member can be maintained, enabling an efficient introduction of refrigerant.

The valve body may include a protruding coupling end portion that protrudes toward the valve fixing part from an opposite end of the valve part, and the valve fixing part may include a coupling groove disposed in an inner circumference of an end portion facing the valve body such that the protruding coupling end portion is inserted and received.

Accordingly, the valve fixing part can be simply coupled while the valve body primarily maintains the opening direction of the plate member by the structure in which the protruding coupling end portion of the valve body is coupled to the coupling groove of the valve fixing part.

That is, the valve body and the valve fixing part can be easily coupled to each other by the protruding coupling end portion and the coupling groove. For example, after the valve body is first installed on the fixed scroll to maintain the opening direction, the coupling groove of the valve fixing part can be fitted to the coupling groove of the valve fixing part.

In addition, the valve fixing part may be press-fitted to the side surface disposed on the suction port of the fixed scroll.

An inlet coupling portion may be disposed in an inner circumference of an opposite side of the valve fixing part to the valve part, such that an inlet tube is installed therein.

In addition, the inlet coupling portion may be formed such that an inner circumference thereof has a polygonal structure for fixing the inlet tube.

By this structure, the inlet tube can be firmly fixed without rotating in the inlet coupling portion.

The valve fixing part may further include a sealing portion connected to the screw portion and disposed on an outer circumference of an opposite side to the valve part.

Accordingly, the check valve can seal or improve sealing performance of a fluid such as refrigerant in a gap formed with the side surface forming the suction port of the fixed scroll.

The sealing portion may protrude radially more than the screw portion, and the valve fixing part may include an inlet coupling portion disposed in an inner circumference of an opposite side thereof to where the valve part is disposed, such that an inlet tube is installed, and a collar coupling portion formed more inward than the inlet coupling portion to form a step, such that a collar member is installed to be fitted to an inner circumference of the inlet tube

Advantageous Effects of Invention

In a scroll compressor according to the present disclosure, a valve fixing part of a check valve can be installed directly through a side surface disposed on a suction port of a fixed scroll, such that the check valve can be simply assembled to the fixed scroll without a change of a complicated structure.

In the scroll compressor according to the present disclosure, the valve fixing part disposed in the side surface disposed on the suction port of the fixed scroll enables the check valve to be directly coupled. By such a modular check valve, the check valve can be easily assembled to the fixed scroll without mounting a separate shell adapter or manufacturing a new shell.

In addition, in the scroll compressor according to the present disclosure, the valve fixing part of the check valve can be screw-coupled to the side surface disposed on the suction port of the fixed scroll, such that the check valve can be simply assembled to the fixed scroll without a change of a complicated structure.

In addition, in the scroll compressor of the present disclosure, a protruding coupling end portion of a valve body can be fitted to a coupling groove of the valve fixing part to receive the coupling groove. With the structure in which the protruding coupling end portion of the valve body is coupled to the coupling groove, the valve fixing part can be simply coupled while the valve body primarily maintains an opening direction of a plate member.

That is, the valve body and the valve fixing part can be easily coupled by fitting the coupling groove to the protruding coupling end portion. For example, after the valve body is first installed on the fixed scroll to maintain the opening direction, the coupling groove of the valve fixing part can be fitted to the coupling groove of the valve fixing part.

In addition, in the scroll compressor according to the present disclosure, refrigerant flows through the suction port when the compressor is in operation, and when the compressor is stopped, a hinge part is closed due to a difference between high pressure inside a compression unit and low pressure in a suction part, thereby blocking the high pressure and the low pressure from each other.

In the scroll compressor according to the present disclosure, a plate member receiving groove may be formed in the suction port of the fixed scroll from one side to another side of the compression chamber along a path along which the plate member rotates. Accordingly, the plate member can smoothly rotate in the suction port of the fixed scroll.

In addition, in the scroll compressor according to the present disclosure, since a refrigerant suction pipe is coupled to the coupling portion of the check valve through an inlet tube and a collar member, the refrigerant suction pipe can be firmly supported and connected and refrigerant can be stably supplied to a compression chamber.

In addition, in the scroll compressor according to the present disclosure, the check valve can be applied to suppress the backflow of refrigerant when the operation of the scroll compressor is stopped. The refrigerant suction pipe can be coupled to the fixed scroll in the same manner as that in the existing mass-production method.

In addition, in the scroll compressor according to the present disclosure, an inlet tube can be stably supported by a suction tube that is coupled between a casing and the inlet tube, and can stably support the refrigerant suction pipe fitted to an inner circumference of the inlet tube.

In addition, in the scroll compressor according to the present disclosure, an inlet coupling portion in which the inlet tube is installed may be disposed in the valve fixing part, and have a structure with a polygonal inner circumference. Accordingly, the inlet tube can be firmly fixed without rotation in the inlet coupling portion.

In addition, in the present disclosure, the valve fixing part may include a sealing portion that is disposed on an outer circumference on an opposite side to the valve part and is connected to the screw portion. Therefore, the check valve can seal a fluid such as refrigerant or more improve sealing performance of such fluid in a gap formed with the side surface forming the suction port of the fixed scroll.

MODE FOR THE INVENTION

Hereinafter, description will be given in more detail of a scroll compressor 10 according to the present disclosure, with reference to the accompanying drawings.

For the sake of brief description with reference to the drawings, the same or equivalent components may be provided with the same or similar reference numbers, and description thereof will not be repeated.

In addition, a structure that is applied to one embodiment will be equally applied to another embodiment as long as there is no structural and functional contradiction in the different embodiments.

A singular representation may include a plural representation unless it represents a definitely different meaning from the context.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
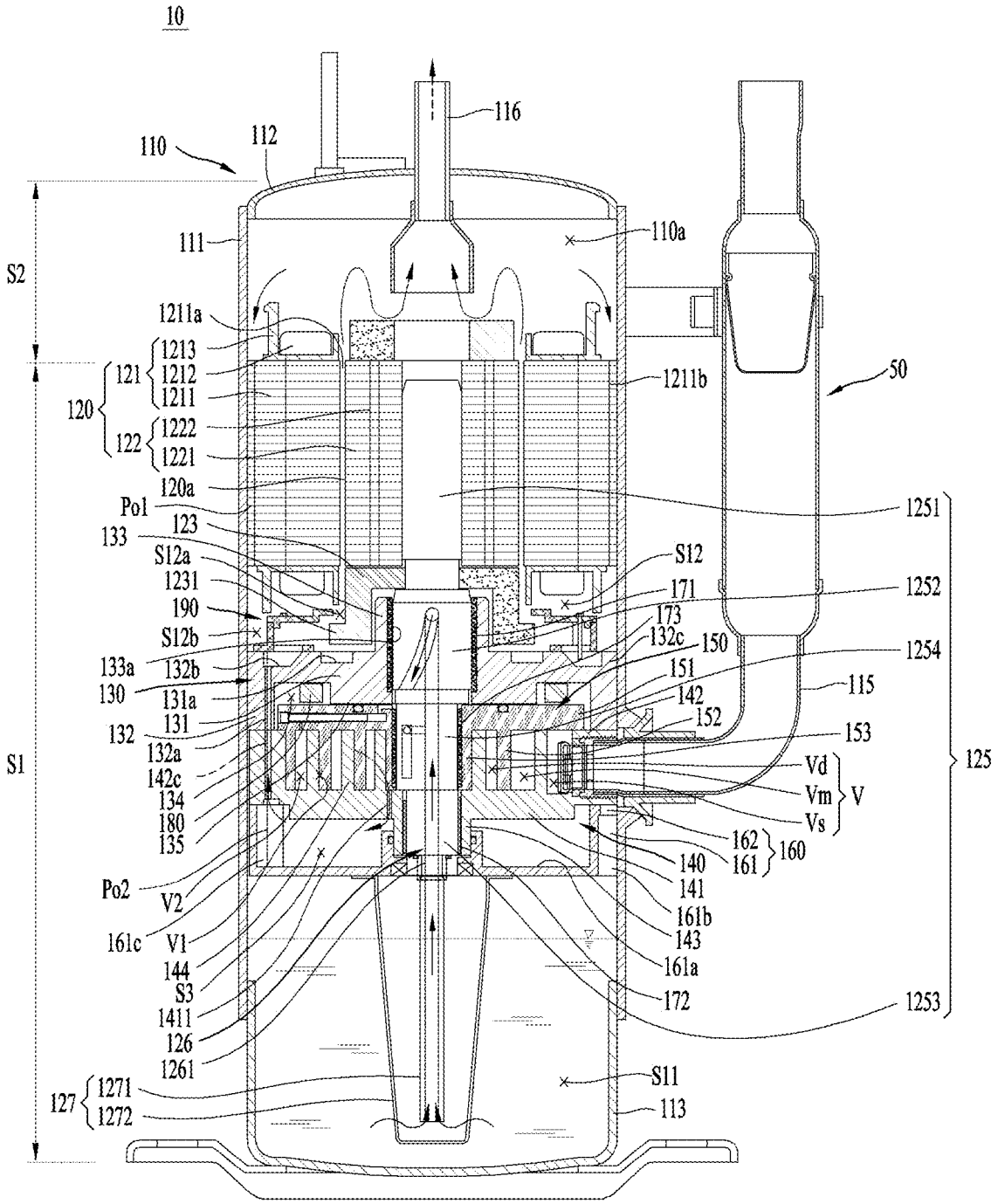
FIG. 1 is a cross-sectional view illustrating a scroll compressor according to the present disclosure.
Figure 2:
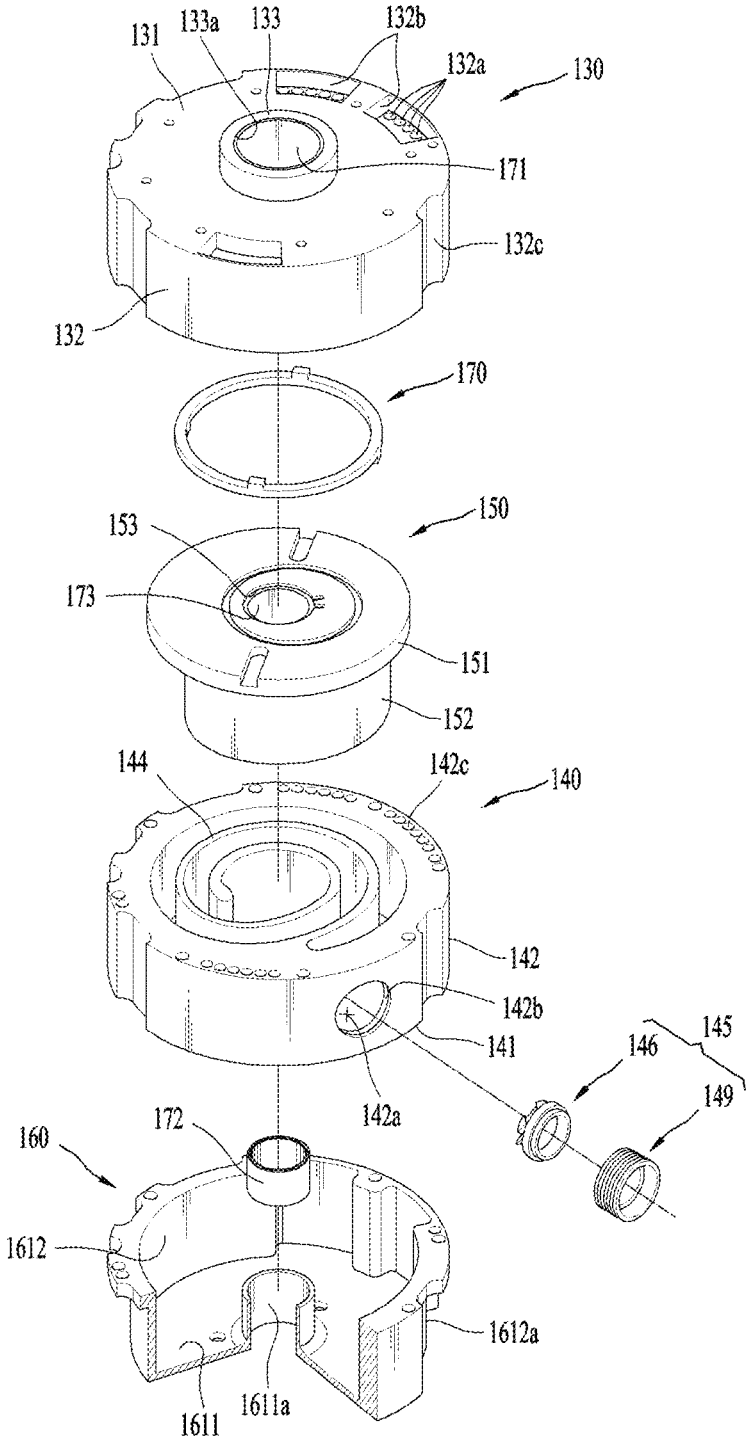
FIG. 2 is an exploded perspective view of a part of FIG. 1.
Figure 3:
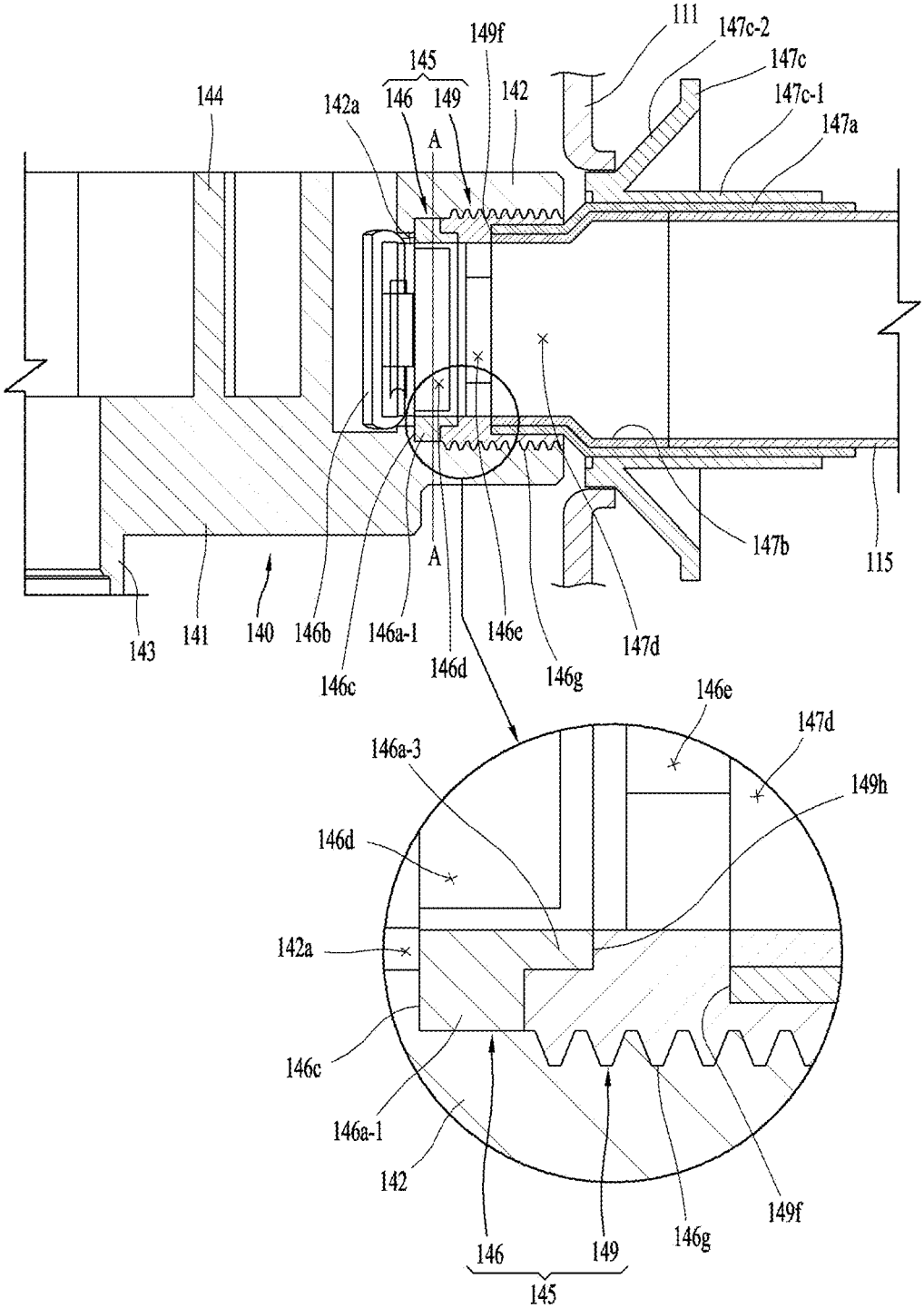
FIG. 3 is a cross-sectional view illustrating an example in which a check valve is installed on a side portion of a fixed scroll.
Figure 5:
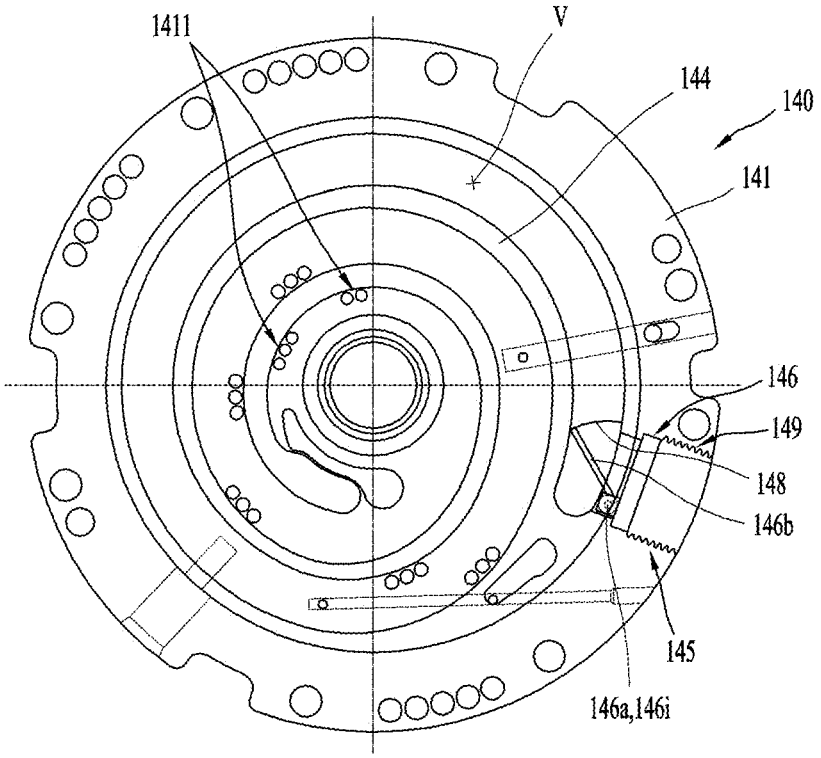
FIG. 5 is a plan view illustrating an example in which the check valve is installed on the fixed scroll.

FIG. 1 is a cross-sectional view illustrating a scroll compressor 10 according to the present disclosure, FIG. 2 is an exploded perspective view of a part of FIG. 1, FIG. 3 is a cross-sectional view illustrating an example in which a check valve 145 is installed on a side portion of a fixed scroll 140, and FIG. 5 is a plan view illustrating an example in which the check valve 145 is installed on the fixed scroll 140.

Hereinafter, a structure of a scroll compressor 10 according to the present disclosure will be described, with reference to FIGS. 1 to 5.

The scroll compressor 10 according to the present disclosure includes a casing 110 defining appearance, a driving unit 120 installed inside the casing 110 to generate driving force, a rotary shaft 125 rotatably installed in the driving unit 120, a compression unit including an orbiting scroll 150 orbitally installed on the rotary shaft 125, and a fixed scroll 140 engaged with the orbiting scroll 150 to form a compression chamber V with the orbiting scroll 150, and a check valve 145 installed through a side surface of the fixed scroll 140, having one side disposed to face the compression chamber V so as to guide an inflow of refrigerant when open, and closed when the compressor is stopped to suppress a reverse flow of the refrigerant.

This can result in suppressing the reverse flow of refrigerant when the scroll compressor 10 is stopped.

In addition, a suction pipe can be inserted even without changing the shape of a shell of the scroll compressor 10, namely, the shell mass-produced in the related art. The shell of the scroll compressor 10 may be the casing 110.

In this way, the check valve 145 of the scroll compressor 10 according to the present disclosure is configured as a "modular check valve 145" that the check valve 145 is installed through the side surface of the fixed scroll 140.

The check valve 145 may be screwed or press-fitted to the side surface of the fixed scroll 140.

Additionally, the check valve 145 includes a valve part 146 and a valve fixing part 149.

The valve part 146 is disposed so that one side faces the compression chamber V. The valve part 146 is open to guide the suction of refrigerant and closed when the compressor is stopped to suppress a reverse flow of the refrigerant. The valve fixing part 149 is installed through a side surface formed on a suction port 142*a* of the fixed scroll 140.

FIG. 3 illustrates an example in which the valve fixing part 149 is screwed to a side surface of the suction port 142*a* of the fixed scroll 140.

When the valve fixing part 149 is screwed to a side surface forming the suction port 142*a* of the fixed scroll 140, the valve fixing part 149 may include a screw portion 146*g*, and the screw portion 146*g* may be formed to extend spirally in a circumferential direction.

In addition, a check valve coupling portion 142*b* may be provided on the side surface of the fixed scroll 140. The check valve coupling portion 142*b* is provided with a screw thread that extends spirally to be spirally coupled to the screw portion 146*g* of the valve fixing part 149.

In this way, the valve fixing part 149 which includes the screw portion 146*g* can be screw-coupled to the side surface of the suction port 142*a* of the fixed scroll 140.

Meanwhile, as described above, the valve fixing part 149 of the check valve 145 according to the present disclosure may be press-fitted to the side surface of the suction port 142*a* of the fixed scroll 140. In the case of press-fitting, the valve fixing part 149 does not have the screw portion 146*g*, and similarly, the check valve coupling portion 142*b* does not have a screw. In this case, an outer circumference of the valve fixing part 149 is press-fitted to an inner circumference of the check valve coupling portion 142*b* in an interference-fitting (shrink-fitting) manner.

The valve part 146 may include a valve body 146*a*-1 and a plate member 146*b*.

The valve body 146*a*-1 may have one side inserted into the valve fixing part 149 and may have a refrigerant flow passage 146*e* through which refrigerant flows.

The plate member 146*b* may be rotatably connected to the valve body 146*a*-1 so as to be provided on one side adjacent to the compression chamber V. The plate member 146*b* may be rotatably installed to be open when refrigerant is introduced and closed when the compressor is stopped, thereby suppressing the reverse flow of the refrigerant.

The valve body 146*a*-1 may be provided with a rotation-limiting end portion 146*c*.

The valve body 146*a*-1 is provided with an opening direction maintaining portion 146*a*-2 formed by D-cutting one side of an outer circumference thereof to maintain an opening direction of the plate member 146*b*. In addition, the fixed scroll 140 may be provided with a guide groove 142*d* formed in a side surface of the suction port 142*a* of the fixed scroll 140 and engaged with the opening direction maintaining portion 146*a*-2 to maintain the opening direction of the plate member 146*b*.

Figure 4:
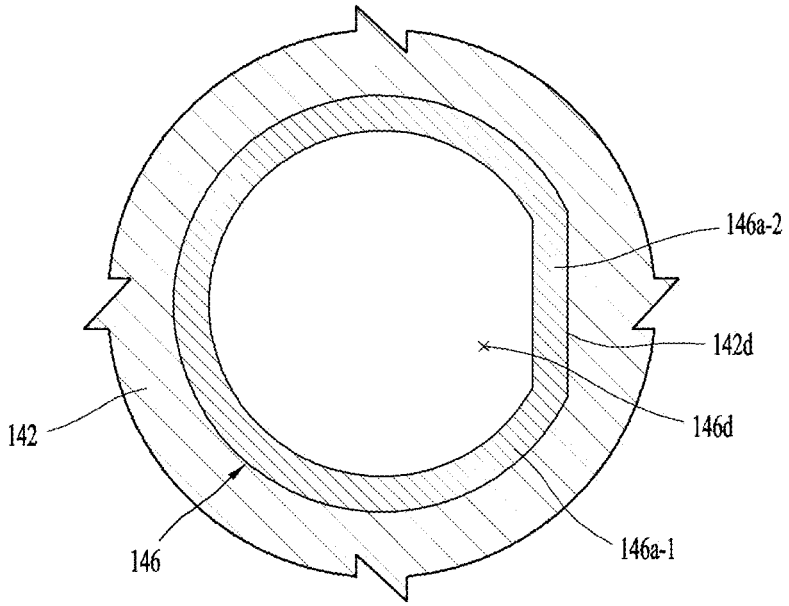
FIG. 4 is a cross-sectional view taken along the line A-A in FIG. 3 for illustrating an example in which a valve body is coupled to the side portion of the fixed scroll.

Referring to FIG. 4, an example is shown in which the valve body is installed on the side surface of the suction port 142*a* of the fixed scroll 140 by the opening direction maintaining portion 146*a*-2 cut into the D-cut shape and the guide groove 142*d* engaged with the opening direction maintaining portion 146*a*-2.

Due to this, the opening direction of the plate member 146*b* is maintained during an assembly or compression process, enabling efficient introduction of compressed refrigerant.

In addition, the valve body 146*a*-1 may include a protruding coupling end portion 146*a*-3 that protrudes from an opposite end of the valve part 146 toward the valve fixing part 149, and the valve fixing part 149 may include a coupling groove 149*h* formed on an inner circumference of an end portion facing the valve body 146*a*-1 and fitted to receive the protruding coupling end portion 146*a*-3.

Due to this, the valve body 146*a*-1 and the valve fixing part 149 can be easily coupled to each other by the protruding coupling end portion 146*a*-3 and the coupling groove 149*h*. For example, after the valve body 146*a*-1 is first installed in the fixed scroll 140 to maintain the opening direction, the coupling groove 149*h* of the valve fixing part 149 may be fitted to the protruding coupling end portion 146*a*-3 of the valve body 146*a*-1.

The rotation-limiting end portion 146*c* may be disposed on one surface facing the compression chamber V and supports the plate member 146*b* while restricting the plate member 146*b* from rotating in one direction to suppress the reverse flow of refrigerant.

The valve fixing part 149 may include an inlet coupling portion 149*f* that is disposed on an inner circumference of an opposite side to the valve part 146 and on which an inlet tube 147*a* is installed.

The inlet coupling portion 149*f* may be disposed inside the valve fixing part 149 of the check valve 145, and may be formed such that the inlet tube 147*a* can be inserted.

Figure 7:
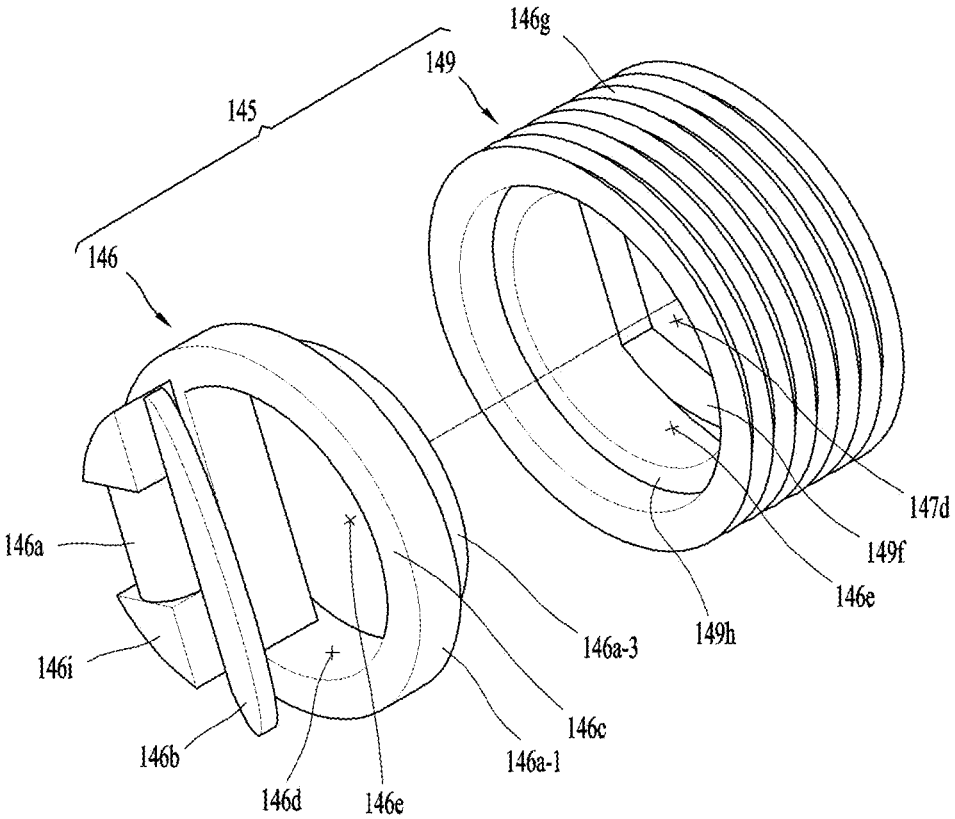
FIG. 7 is an exploded perspective view of the check valve according to the present disclosure.

The inlet coupling portion 149*f* may be formed in a polygonal shape. As an example, FIG. 7 illustrates an example of the inlet coupling portion 149*f* formed in a hexagonal structure.

However, it is not necessarily limited to this structure, and the inlet coupling portion 149*f* may be formed in a circular, octagonal, or dodecagonal shape.

By this structure, the inlet tube 147*a* can be firmly fixed without rotating in the inlet coupling portion 149*f*.

The inlet coupling portion 149*f* may be disposed on the inner circumference of the screw portion 146*g* of the valve fixing part 149 that is coupled to the side portion of the fixed scroll 140.

The inlet tube 147*a* may be coupled to the inlet coupling portion 149*f*.

Alternatively, a collar member 147*b* may be further installed on an inner circumference of the inlet tube 147*a* coupled to the inlet coupling portion 149*f*.

The collar member 147*b* is coupled to the inner circumference of the inlet tube 147*a* and presses the inner circumference of the inlet tube 147*a*, so that the inlet tube 147*a* can be supported by the inlet coupling portion 149*f* of the check valve 145.

For example, the collar member 147*b* may be press-fitted onto the inner circumference of the inlet tube 147*a*.

In addition, a refrigerant inlet passage 147*d* through which refrigerant can flow may be provided on an inner circumference of the collar member 147*b*, and the refrigerant inlet passage 147*d* of the collar member 147*b* may communicate with the compression chamber V through an inlet portion 146*d* of the check valve 145.

The scroll compressor 10 according to the present disclosure may further include a refrigerant suction pipe 115 connected to the check valve 145 to allow gaseous refrigerant to flow into the compression chamber V.

A refrigerant suction pipe 115 is inserted into the inlet tube 147*a* to communicate with the inlet portion 146*d* of the check valve 145.

A suction tube 147*c* disposed on an outer circumference of the inlet tube 147*a* may be disposed on an end portion of the refrigerant suction pipe 115. The suction tube 147*c* supports the outer circumference of the inlet tube 147*a* to suppress the refrigerant suction tube 115 from being separated from the inner circumference of the inlet tube 147*a*.

For example, the suction tube 147*c* may be coupled between the casing 110 (or the cylindrical shell 111) and the inlet tube 147*a* to support the outer circumference of the inlet tube 147*a*.

For this purpose, the casing 110 (or the cylindrical shell 111) may be provided with a coupling hole in which the suction tube 147*c* is installed (FIG. 3). In this case, the suction tube 147*c* has a structure to be coupled between the coupling hole of the casing 110 (or the cylindrical shell 111) and the inlet tube 147*a* to support the outer circumference of the inlet tube 147*a*.

The inlet tube 147*a* can be supported with respect to the cylindrical shell 111 by the suction tube 147*c*.

In addition, the suction tube 147*c* may be welded on each of the cylindrical shell 111 and the inlet tube 147*a* between the cylindrical shell 111 and the inlet tube 147*a* after the inlet tube 147*a* is inserted into the inlet coupling portion 149*f* disposed inside the valve fixing part 149 of the check valve 145.

Referring to FIG. 3, the suction tube 147*c* may include a contact portion 147*c*-1 installed to be supported on the outer circumference of the inlet tube 147*a*, and a support portion 147*c*-2 connected in a direction intersecting with the contact portion 147*c*-1 and supported on the cylindrical shell 111 of the casing 110.

The inlet tube 147*a* can be stably supported by the suction tube 147*c* coupled between the casing 110 (or the cylindrical shell 111) and the inlet tube 147*a*, so as to stably support the refrigerant suction tube 115 inserted into the inner circumference thereof.

In this way, as the refrigerant suction pipe 115 is coupled to the inlet coupling portion 149*f* of the check valve 145 through the inlet tube 147*a* and the collar member 147*b*, the refrigerant suction pipe 115 can be firmly supported on the check valve 145, and refrigerant can be stably supplied to the compression chamber V.

The valve part 146 of the check valve 145 may include a plate member 146*b* that suppresses the reverse flow of the refrigerant supplied to the compression chamber V.

The plate member 146*b* may be disposed on one side of the check valve 145, which is adjacent to the compression chamber V, to be rotatable.

For example, the plate member 146*b* may be hinge-coupled to the check valve 145.

The plate member 146*b* may be provided with a rotating portion 146*a* that is rotatably installed on one side of the check valve 145. A pin may be installed through the rotating portion 146*a*. In addition, the pin installed through the rotating portion 146*a* is installed in a rotation support portion 146*i*, which is disposed on one side of the check valve 145, so that the plate member 146*b* can rotate relative to the check valve 145 while being supported by the rotating support portion 146*i*.

The plate member 146*b* is open when the compressor is operating, allowing refrigerant to flow in through the inlet portion 146*d*.

The plate member 146*b* forms a structure that rotates relative to the rotating portion 146*a*, which may be a swing type check valve 145.

The plate member 146*b* may be formed in a circular shape, for example. the plate member 146*b* is preferably formed in a circular shape in order to open and close the inlet portion 146*d* because the rotation-limiting end portion 146*c* forming the inlet portion 146*d* is formed in a circular shape. The plate member 146*b* preferably has a diameter that is greater than a diameter of the inlet portion 146*d* and smaller than an outer diameter of the outer circumference of the rotation-limiting end portion 146*c*, to thus properly close the inlet portion 146*d*.

In addition, the check valve 145 may further include the rotation-limiting end portion 146*c*.

The rotation-limiting end portion 146*c* may support the plate member 146*b* while limiting the rotation of the plate member 146*b* in one direction.

The inlet portion 146*d* through which refrigerant flows into the compression chamber V may be formed inside the rotation-limiting end portion 146*c*.

The one direction may be a direction that refrigerant reversely flows, opposite to a direction that the refrigerant flows into the compression chamber V.

The rotation-limiting end portion 146*c* support the plate member 146*b* while limiting the rotation of the plate member 146*b* in the one direction. Accordingly, the plate member 146*b* is blocked and closed by the rotation-limiting end portion 146*c* due to a difference between high pressure inside the compression chamber V and low pressure of a suction part when the scroll compression 10 is stopped, thereby separating the high pressure and the low pressure from each other, resulting in suppressing reverse flow.

The casing 110 is formed to define appearance.

The scroll compressor 10 according to the present disclosure may be a shaft-through scroll compressor 10 in which the rotary shaft 125 is disposed to penetrate the orbiting scroll 150 and the fixed scroll 140. As illustrated in FIG. 1, the scroll compressor 10 can be understood as a "shaft-through scroll compressor 10" in which the rotary shaft 125 is disposed to penetrate the compression unit including the orbiting scroll 150 and the fixed scroll 140.

Meanwhile, the scroll compressor 10 according to the present disclosure is a bottom-compression type scroll compressor 10 as illustrated in FIG. 1, and although the description is mainly given of the bottom-compression type scroll compressor 10, the present disclosure is not necessarily limited thereto.

That is, the scroll compressor 10 according to the present disclosure, if it is the shaft-through scroll compressor 10, may also be applied to a top-compression type scroll compressor 10 in which the compression unit is located above the driving unit 120.

In addition, the present disclosure may have the check valve 145 installed through the side surface of the fixed scroll 140 to suppress reverse flow of refrigerant when the scroll compressor 10 is stopped.

More specifically, the valve fixing part 149 may be screwed to the side surface of the suction port 142*a* of the fixed scroll 140. Thus, the check valve 145 is installed as a "modular check valve 145," thereby enabling the refrigerant suction pipe 115 to be coupled to the fixed scroll 140 in the same manner as that in the existing mass production method.

The detailed structure related to the check valve 145 will be described later.

In addition, a description will be given of a bottom-compression type scroll compressor 10 in which the driving unit and the compression unit are arranged vertically in an axial direction and the compression unit is located below the driving unit 120.

In addition, a description will be given of a bottom-compression high-pressure type scroll compressor 10 in which the refrigerant suction pipe 115 defining a suction passage is directly connected to the compression unit and a refrigerant discharge pipe 116 communicates with an inner space of the casing 110.

However, the scroll compressor 10 according to the present disclosure is not necessarily limited to the bottom-compression type, and may also be applied to the top-compression type in which the compression unit is located above the driving unit 120.

The scroll compressor 10 according to the present disclosure may be an inverter type scroll compressor. The scroll compressor 10 can operate in the range from a low speed to a high speed. The scroll compressor 10 may also be a high-pressure and bottom-compression type.

FIG. 1 illustrates the bottom-compression type scroll compressor 10. As illustrated in FIG. 1, the scroll compressor 10 according to an embodiment of the present disclosure can be understood as a bottom-compression type scroll compressor 10 in which the driving unit 120 constituting a drive motor in the inner space 1*a* of the casing 110 and generating rotational force is installed in an upper portion of the casing 110, and the compression unit compressing refrigerant by receiving the rotational force of the driving unit 120 is installed below the driving unit 120.

The casing 110 has an oil storage space S11. As an example, the driving unit 120 may be disposed in the upper portion of the casing 110, and the main frame 130, the orbiting scroll 150, the fixed scroll 140, and the discharge cover 160 may be sequentially disposed below the driving unit 120.

The driving unit 120 may be configured to convert external electrical energy into mechanical energy.

In addition, the main frame 130, the orbiting scroll 150, the fixed scroll 140, and the discharge cover 160 may configure the compression unit that compresses refrigerant by receiving the mechanical energy generated in the driving unit 120.

Referring to FIG. 1, an example is shown in which the driving unit is coupled to an upper end of the rotary shaft 125 to be explained later, and the compression unit is coupled to a lower end of the rotary shaft 125. That is, the scroll compressor 10 may have a bottom-compression type structure.

In summary, the scroll compressor 10 includes the driving unit 120 and the compression unit which are received in the inner space 110*a* of the casing 110.

The casing 110 may include a cylindrical shell 111, an upper shell 112 and a lower shell 113.

The cylindrical shell 111 may be formed in a cylindrical shape with both ends open.

The upper shell 112 may be coupled to an upper end portion of the cylindrical shell 111, and the lower shell 113 may be coupled to a lower end portion of the cylindrical shell 111.

That is, both the upper and lower end portions of the cylindrical shell 111 are coupled to the upper shell 112 and the lower shell 113, respectively, in a covering manner. The cylindrical shell 111, the upper shell 112 and the lower shell 113 that are coupled together define the inner space 110*a* of the casing 110. At this time, the inner space 110*a* is sealed.

The sealed inner space 110*a* of the casing 110 is divided into a lower space S1, an upper space S2, an oil storage space S11, and a discharge space S3.

The lower space S1 and the upper space S2 are defined in an upper side of the main frame 130 and the oil storage space S11 and the discharge space S3 are defined in a lower side of the main frame 130.

The lower space S1 indicates a space defined between the driving unit 120 and the main frame 130, and the upper space S2 indicates a space above the driving unit 120. In addition, the oil storage space S11 indicates a space below the discharge cover 160, and the discharge space S3 indicates a space defined between the discharge cover 160 and the fixed scroll 140.

A suction pipe receiving hole through which one end of the refrigerant suction pipe 115 is coupled is formed through a side surface of the cylindrical shell 111. The one end of the refrigerant suction pipe 115 may be coupled to the cylindrical shell 111 in the radial direction of the cylindrical shell 111. For example, one end of the refrigerant suction pipe 115 can be radially coupled through the suction pipe receiving hole formed through the side surface of the cylindrical shell 111.

The refrigerant suction pipe 115 may be coupled through the cylindrical shell 111 to communicate with the suction port 142*a* formed in the side portion of the fixed scroll 140.

In the present disclosure, as described above, the check valve 145 is installed through the side surface of the fixed scroll 140 to suppress the reverse flow of refrigerant when the compressor is stopped. The refrigerant suction pipe 115 is disposed on the opposite side of the compression chamber V with the check valve 145 therebetween, and is connected to the check valve 145 to communicate with the refrigerant flow passage 146*e* of the check valve 145.

Figure 6:
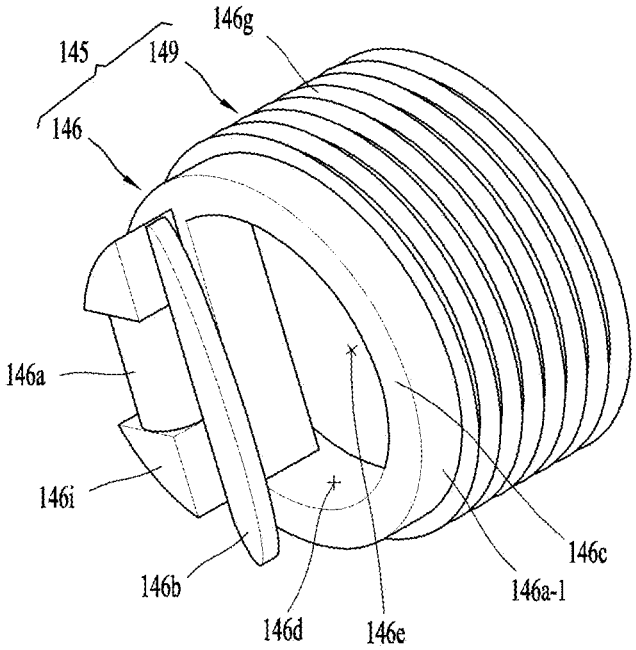
FIG. 6 is a perspective view of the check valve according to the present disclosure.
Figure 8:
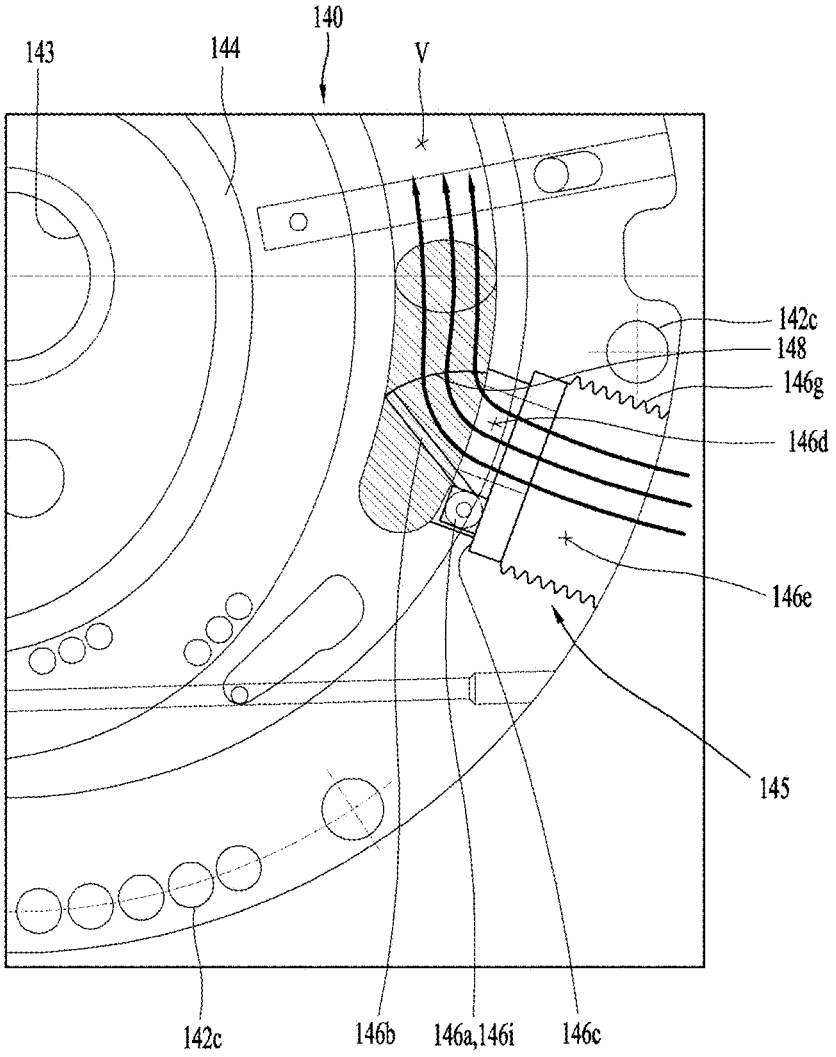
FIG. 8 is a conceptual diagram illustrating an inflow of refrigerant when the check valve is open.
Figure 9:
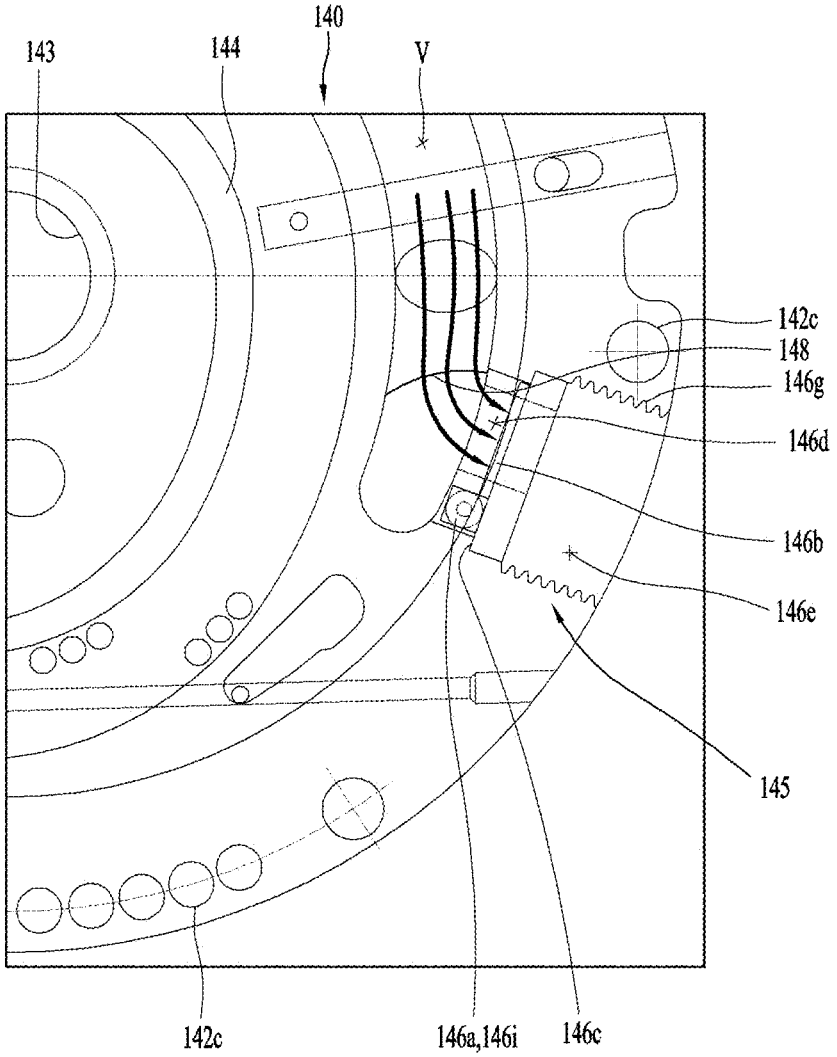
FIG. 9 is a conceptual diagram illustrating a state in which the check valve is closed.

FIG. 6 is a perspective view of the check valve 145 according to the present disclosure, and FIG. 8 is a conceptual diagram illustrating the inflow of refrigerant when the check valve 145 is open. In addition, FIG. 9 is a conceptual diagram illustrating a state in which the check valve 145 is closed.

Hereinafter, the structure and operation of the check valve 145 will be described in more detail.

As described above, the check valve 145 may be screwed or press-fitted to the side surface of the fixed scroll 140.

Referring to FIGS. 3, 5, and 8, an example is shown in which the valve fixing part 149 is screw-coupled to the side surface of the fixed scroll 140.

When the valve fixing part 149 is screw-coupled, the valve fixing part 149 may include a screw portion 146*g*, and the screw portion 146*g* may be formed to extend spirally in a circumferential direction.

Referring to FIGS. 6 and 7, an example is shown in which the screw portion 146*g* spirally protrudes from an outer circumference of the right side of the valve fixing part 149 in a circumferential direction.

In addition, as described above, the check valve coupling portion 142*b* may be provided on the side surface of the fixed scroll 140.

When the valve fixing part 149 is screw-coupled to the suction port 142*a* of the fixed scroll 140, the check valve coupling portion 142*b* may have the screw portion 146*g* that spirally extends from the inner circumference thereof to be engaged with the screw portion 146*g* of the valve fixing part 149.

The valve part 146 may include the valve body 146*a*-1 and the plate member 146*b*.

The valve body 146*a*-1 may have one side inserted into the valve fixing part 149 and may have the refrigerant flow passage 146*e* through which refrigerant flows.

The plate member 146*b* may be rotatably connected to the valve body 146*a*-1 to be disposed on one side adjacent to the compression chamber V. The plate member 146*b* may be rotatably installed to be open when refrigerant is introduced and closed when the compressor is stopped, thereby suppressing the reverse flow of the refrigerant.

The rotating portion 146*a* is rotatably disposed on one side adjacent to the compression chamber V.

A pin may be installed through the rotating portion 146*a*. In addition, the pin installed through the rotating portion 146*a* is disposed in a rotation support portion 146*i*, which is disposed on one side of the check valve 145, so that the plate member 146*b* can rotate relative to the check valve 145 while being supported by the rotating support portion 146*i*.

The plate member 146*b* is connected to the rotating portion 146*a* to be rotatable on one side of the check valve 145.

The plate member 146*b* guides the inflow of refrigerant into the compression chamber V in an open state. Additionally, the plate member 146*b*, in a closed state, suppresses the backflow of refrigerant supplied to the compression chamber V.

In this way, the plate member 146*b* forms a rotatable structure on one side adjacent to the compression chamber V by means of the rotating portion 146*a* disposed on the check valve 145, and this structure may be understood as a hinge structure.

The plate member 146*b* is open when the compressor is operating, allowing refrigerant to be introduced through the inlet portion 146*d*.

The plate member 146*b* forms a structure that rotates relative to the rotating portion 146*a*, which may be a swing type check valve 145.

The plate member 146*b* may be formed in a circular plate shape, for example. This is because the rotation-limiting end portion 146*c* forming the inlet portion 146*d* is formed in the circular shape and the inlet portion 146*d* has to be open and closed.

The plate member 146*b* preferably has a diameter that is greater than a diameter of the inlet portion 146*d* and smaller than an outer diameter of the outer circumference of the rotation-limiting end portion 146*c*, to thus properly close the inlet portion 146*d*.

In addition, the check valve 145 may further include the rotation-limiting end portion 146*c*.

The rotation-limiting end portion 146*c* may support the plate member 146*b* while limiting the rotation of the plate member 146*b* in one direction.

The inlet portion 146*d* through which refrigerant flows into the compression chamber V may be formed inside the rotation-limiting end portion 146*c*.

The one direction may be a direction that refrigerant reversely flows, opposite to a direction that the refrigerant flows into the compression chamber V.

In addition, the one direction may be a horizontal direction intersecting an up-down (vertical) direction of the scroll compressor 10 of the present disclosure.

The rotation-limiting end portion 146*c* supports the plate member 146*b* while limiting the rotation of the plate member 146*b* in the one direction. Accordingly, the plate member 146*b* is blocked and closed by the rotation-limiting end portion 146*c* due to a difference between high pressure inside the compression chamber V and low pressure of a suction part when the scroll compression 10 is stopped, thereby blocking the high pressure and the low pressure from each other, resulting in suppressing a reverse flow.

FIGS. 6 and 7 illustrate an example in which the rotation-limiting end portion 146*c* is disposed on the end portion of the valve body 146*a*-1 formed in a ring shape, and the inlet portion 146*d* is disposed inside the valve body 146*a*-1.

The inlet coupling portion 149*f* is disposed on another side opposite to the one side where the rotating portion 146*a* and the plate member 146*b* are disposed. In addition, the inlet coupling portion 149*f* is disposed inside the check valve 145. Also, the inlet coupling portion 149*f* may be disposed on the inner circumference of the screw portion 146*g* that is coupled to the side portion of the fixed scroll 140.

For example, the inlet coupling portion 149*f* may be formed in a polygonal or circular shape. For example, FIG. 7 illustrates an example of the inlet coupling portion 149*f* formed in a hexagonal structure, but is not necessarily limited to this structure, and may alternatively be formed in an octagonal or a dodecagonal shape.

The inlet tube 147*a* that guides the insertion of a refrigerant suction pipe 115 may be installed on the inlet coupling portion 149*f*.

In addition, the collar member 147*b* may be further installed on the inner circumference of the inlet tube 147*a* coupled to the inlet coupling portion 149*f*.

The collar member 147*b* is coupled to the inner circumference of the inlet tube 147*a* and presses the inner circumference of the inlet tube 147*a*, so that the inlet tube 147*a* can be supported by the inlet coupling portion 149*f* of the check valve 145.

For example, the collar member 147*b* may be press-fitted onto the inner circumference of the inlet tube 147*a*.

In addition, the refrigerant inlet passage 147*d* through which refrigerant can flow may be provided on an inner circumference of the collar member 147*b*, and the refrigerant inlet passage 147*d* of the collar member 147*b* may communicate with the compression chamber V through the inlet portion 146*d* of the check valve 145.

The refrigerant suction pipe 115 is inserted into the inlet tube 147*a* to communicate with the inlet portion 146*d* of the check valve 145.

The suction tube 147*c* disposed on the outer circumference of the inlet tube 147*a* may be disposed on the end portion of the refrigerant suction pipe 115. The suction tube 147*c* supports the outer circumference of the inlet tube 147*a* to suppress the refrigerant suction tube 115 from being separated from the inner circumference of the inlet tube 147*a*.

In the related art, in order to assemble the check valve, the structure of the casing 110 or shell had to change, and in order to change the structure of the shell, an adapter had to be welded or a mass production line had to be modified due to the production of such new shell.

However, in the scroll compressor 10 according to the present disclosure, any change in the shell structure is not required by virtue of the structure of the check valve 145, the check valve 145 can be simply assembled to the fixed scroll 140, and the existing shell structure can be applied as it is.

In this way, as the refrigerant suction pipe 115 is coupled to the inlet coupling portion 149*f* of the check valve 145 through the inlet tube 147*a* and the collar member 147*b*, the refrigerant suction pipe 115 can be firmly supported on the check valve 145, and refrigerant can be stably supplied to the compression chamber V.

Therefore, the refrigerant can be introduced into the compression chamber V through the refrigerant suction pipe 115 and the check valve 145 communicating with the refrigerant suction pipe 115.

Figure 10:
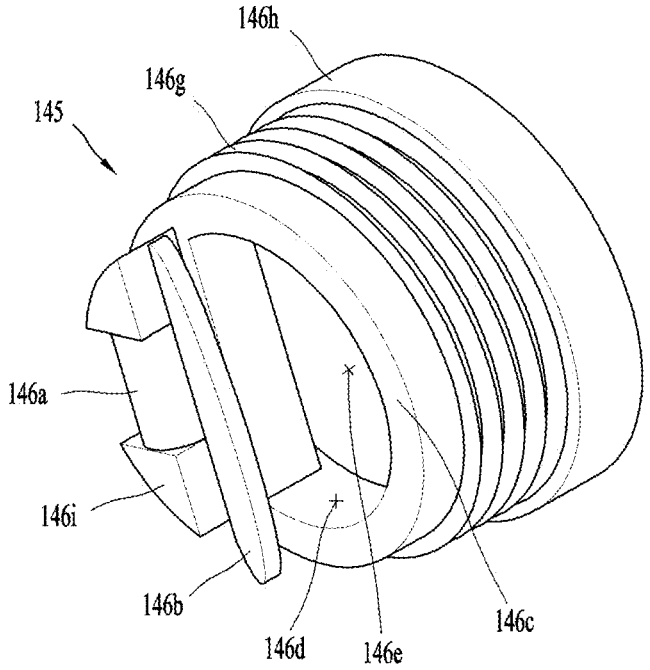
FIG. 10 is a perspective view illustrating another example of a check valve according to the present disclosure.
Figure 11:
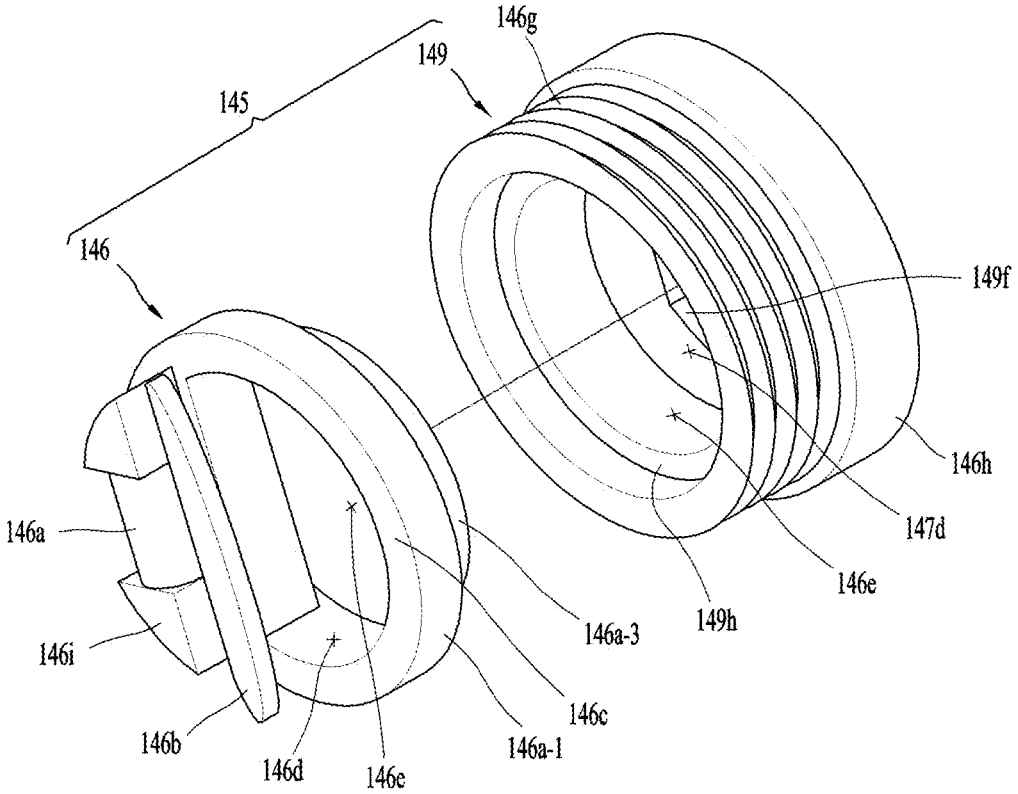
FIG. 11 is an exploded perspective view illustrating another example of the check valve according to the present disclosure.
Figure 12:
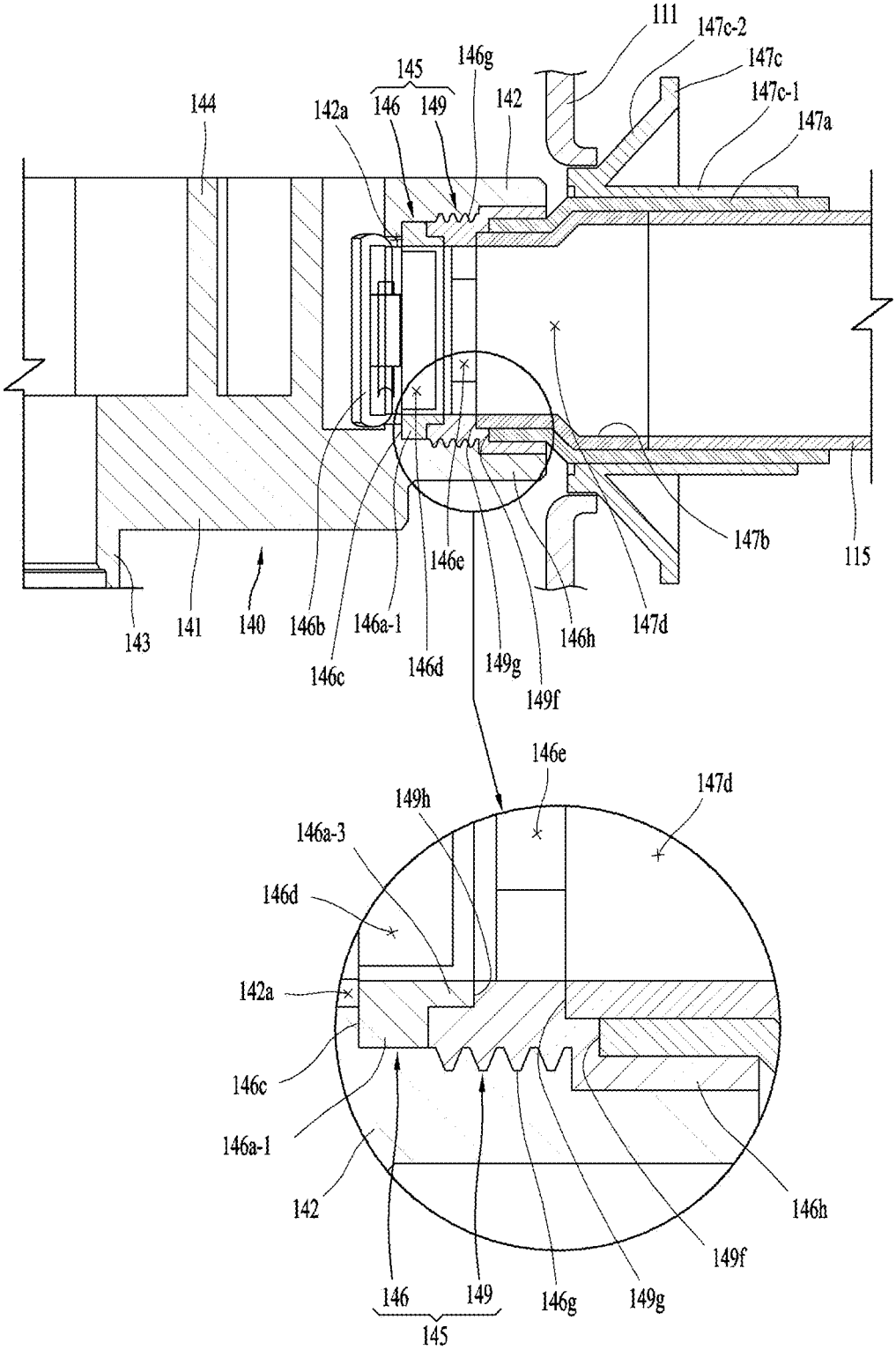
FIG. 12 is a cross-sectional view illustrating an example in which the check valve of FIG. 10 is installed on a side portion of a fixed scroll.
Figure 13:
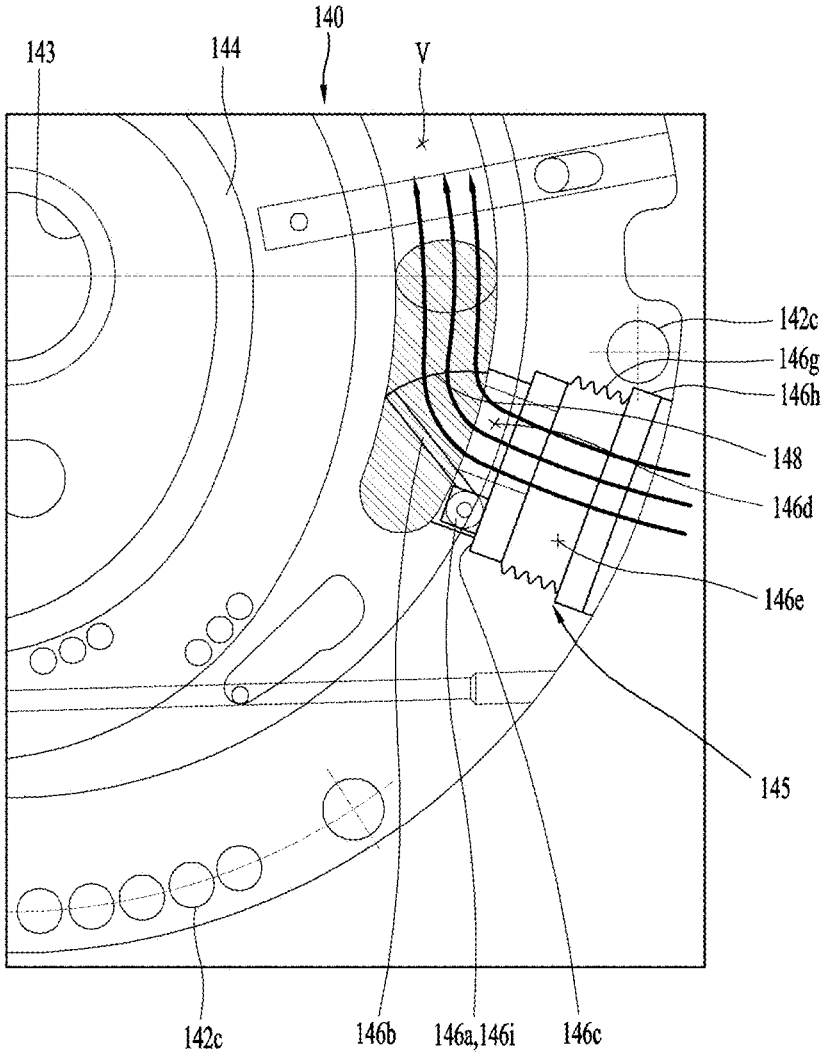
FIG. 13 is a plan view illustrating an example in which the check valve of FIG. 10 is installed on the fixed scroll.

FIG. 10 is a perspective view illustrating another example of the check valve 145 according to the present disclosure, FIG. 12 is a cross-sectional view illustrating an example in which the check valve 145 of FIG. 10 is installed on the side portion of the fixed scroll 140, and FIG. 13 is a plan view illustrating an example in which the check valve 145 of FIG. 8 is installed on the fixed scroll 140.

FIGS. 10 to 13 illustrate other examples of the check valve 145 according to the present disclosure.

Another example of the check valve 145 according to the present disclosure is different from the check valve 145 of the example described above in FIG. 6, etc. in that it further includes a sealing portion 146*h* connected to the screw portion 146*g*.

Referring to FIGS. 10 to 13, a sealing portion 146*h* is further provided adjacent to the screw portion 146*g*.

The sealing portion 146*h* enables sealing between the check valve 145 and the check valve coupling portion 142*b* of the fixed scroll 140. That is, the sealing portion 146*h* may also be named a sealing portion. The sealing portion 146*h* may further include a rubber packing or gasket on an outer circumference thereof to seal a gap between the check valve 145 and the check valve coupling portion 142*b* of the fixed scroll 140.

In this case, the check valve coupling portion 142*b* of the fixed scroll 140 may include a screw thread engaged with the screw portion 146*g* and have an inner circumferential surface which is engaged with the sealing portion 146*h* but does not have a screw thread.

Due to this, the check valve 145 seals or improves sealing performance of a fluid such as refrigerant between the check valve 145 and the check valve coupling portion 142*b* of the fixed scroll 140.

In addition, the sealing portion 146*h* may protrude further in the radial direction than the screw portion 146*g*. In this case, on an inner circumference of the valve fixing part 149 opposite to where the valve part 146 is disposed may be provided the inlet coupling portion 147*f* in which the inlet tube 147*a* is installed, and a collar coupling portion 149*g* that is formed more inward than the inlet coupling portion 149*f* to be stepped and on which the collar member 147*b* inserted into the inner circumference of the inlet tube 147*a* is installed.

The structure is illustrated in FIG. 12.

The inlet coupling portion 149*f* and the collar coupling portion 149*g* which are disposed on the inner circumference of the valve fixing part 149, opposite to where the valve part 146 is disposed, can facilitate coupling and support of the inlet tube 147*a* and the collar member 147*b*, and thus the refrigerant suction pipe 115 can be installed more stably.

Meanwhile, referring back to FIG. 1, an accumulator 50 is coupled to another end, different from the one end, of the refrigerant suction pipe 115.

The accumulator 50 is connected to an outlet side of an evaporator 40 through a refrigerant pipe. Accordingly, while refrigerant flows from the evaporator to the accumulator 50, liquid refrigerant is separated in the accumulator 50, and only gaseous refrigerant is directly introduced into the compression chamber V through the refrigerant suction pipe 115 and the check valve 145 communicating with the refrigerant suction pipe 115.

A refrigerant discharge pipe 116 is coupled through an upper portion of the upper shell 112 to communicate with the inner space 110*a* of the casing 110. Accordingly, refrigerant discharged from the compression unit into the inner space 110*a* of the casing 110 flows to a condenser (not shown) through the refrigerant discharge pipe 116.

The fixed scroll 140 is disposed inside the casing 110. The orbiting scroll 150 is disposed on one side of the fixed scroll 140 to be pivotable, and the fixed scroll 140 forms the compression chamber V together with the orbiting scroll 150.

In addition, the discharge cover 160 is disposed on another side of the fixed scroll 140, opposite to the one side.

The fixed scroll 140 includes a fixed wrap 144. The fixed scroll 140 may further include a sub bearing hole 1431.

The fixed scroll 140 may include a fixed end plate portion 141, a fixed side wall portion 142, a sub bearing portion 143, and a fixed wrap 144, and the check valve 145 is coupled to the side surface of the fixed scroll 140.

The orbiting scroll 150 performs an orbital motion relative to the fixed scroll 140, and is engaged with the fixed wrap 144 to form the compression chamber V.

For example, the orbiting scroll 150 may include an orbiting wrap 152 engaged with the fixed wrap 144 of the fixed scroll 140 to form the compression chamber V, and an orbiting end plate portion 151 connected at one end of the orbiting wrap 152 and having a predetermined width. A detailed structure of the orbiting scroll 150 will be described later.

The rotary shaft 125 may be disposed inside the casing 110 in one direction and disposed on inner circumferences of the fixed scroll 140 and the orbiting scroll 150 to transfer rotational force to enable the orbital motion of the orbiting scroll 150.

The discharge cover 160 is coupled to another side of the fixed scroll 140, which is opposite to the one side thereof defining the compression chamber V. The discharge cover 160 also has a cover bottom surface 1611 forming a bottom of the discharge cover 160. The discharge cover 160 includes a cover side surface 1612 forming the side surface thereof.

A through hole 1611*a* may be formed through a central portion of the cover bottom surface 1611 in the axial direction. A sub bearing portion 143 protruding downward from the fixed end plate portion 141 may be inserted into the through hole 1611*a*, but is not necessarily limited to this structure, and the through hole 1611*a* may be formed in a boss shape and may be fitted directly to the inner circumference of the fixed end plate portion 141 of the fixed scroll 140 rather than the sub bearing portion 143 of the fixed scroll 140.

A discharge hole 163 that can communicate with the inside of an oil feeder 127 may be formed in the cover bottom surface 1611.

The oil feeder 127 is coupled to the cover bottom surface 1611 to face an opposite direction to the fixed scroll 140, so as to communicate with the oil storage space S11.

Referring to FIG. 1, in the high-pressure and bottom-compression type scroll compressor 10 according to an embodiment of the present disclosure, the driving unit 120 constituting the driving unit 120 is installed in the upper half portion of the casing 110, and the main frame 130, the fixed scroll 140, the orbiting scroll 150, and the discharge cover 160 are sequentially disposed below the driving unit 120. Typically, the compression unit may include the main frame 130, the fixed scroll 140, the orbiting scroll 150, and the discharge cover 160.

The driving unit 120 is coupled to an upper end of the rotary shaft 125 to be explained later, and the compression unit is coupled to a lower end of the rotary shaft 125. Accordingly, the compressor has the bottom-compression type structure described above, and the compression unit is connected to the driving unit 120 by the rotary shaft 125 to be operated by the rotational force of the driving unit 120.

Referring to FIG. 1, the casing 110 according to an embodiment of the present disclosure may include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111.

Accordingly, the inner space 110*a* of the casing 110 may be sealed. The sealed inner space 110*a* of the casing 110 is divided into a lower space S1 and an upper space S2 based on the driving unit 120.

The lower space S1 is a space defined below the driving unit 120. The lower space S1 may be further divided into an oil storage space S11 and an outflow space S12 with the compression unit therebetween.

The oil storage space S11 is a space defined below the compression unit to store oil or mixed oil in which liquid refrigerant is contained. The outflow space S12 is a space defined between an upper surface of the compression unit and a lower surface of the driving unit 120. Refrigerant compressed in the compression unit or mixed refrigerant in which oil is contained is discharged into the outflow space S12.

The upper space S2 is a space defined above the driving unit 120 to form an oil separating space in which oil is separated from refrigerant discharged from the compression unit. A refrigerant discharge pipe 116 communicates with the upper space S2.

The driving unit 120 and the main frame 130 are fixedly inserted into the cylindrical shell 111. An outer circumferential surface of the driving unit 120 and an outer circumferential surface of the main frame 130 may be respectively provided with an oil return passages Po1 and Po2 each spaced apart from an inner circumferential surface of the cylindrical shell 111 by a predetermined distance.

A refrigerant suction pipe 115 is coupled through a side surface of the cylindrical shell 111. Accordingly, the refrigerant suction pipe 115 is coupled through the cylindrical shell 111 forming the casing 110 in a radial direction.

The refrigerant suction pipe 115 is formed in an L-like shape. One end of the refrigerant suction pipe 115 is inserted through the cylindrical shell 111 to directly communicate with the suction port 142*a* of the fixed scroll 140, which configures the compression unit. Accordingly, refrigerant can be introduced into a compression chamber V through the refrigerant suction pipe 115.

Another end of the refrigerant suction tube 115 may be connected to an accumulator 50 which defines a suction passage outside the cylindrical shell 111. The accumulator 50 may be connected to an outlet side of the evaporator 40 through the refrigerant pipe. Accordingly, while refrigerant flows from the evaporator to the accumulator 50, liquid refrigerant may be separated in the accumulator 50, and only gaseous refrigerant may be directly introduced into the compression chamber V through the refrigerant suction tube 115.

A terminal bracket (not shown) may be coupled to an upper portion of the cylindrical shell 111 or the upper shell 112, and a terminal (not shown) for transmitting external power to the driving unit 120 may be coupled through the terminal bracket.

An inner end of the refrigerant discharge pipe 116 is coupled through an upper portion of the upper shell 112 to communicate with the inner space 110*a* of the casing 110, specifically, the upper space S2 defined above the drive unit 120.

The refrigerant discharge pipe 116 corresponds to a passage through which compressed refrigerant discharged from the compression part to the inner space 110*a* of the casing 110 is exhausted toward a condenser (not illustrated). The refrigerant discharge pipe 116 may be disposed coaxially with the rotary shaft 125 to be described later. Accordingly, a venturi tube 191 disposed in parallel with the refrigerant discharge pipe 116 may be eccentrically disposed with respect to an axial center of the rotary shaft 125.

The refrigerant discharge pipe 116 may be provided therein with the accumulator 50 for separating oil from refrigerant discharged from the compressor 10 to the condenser, or a check valve (not shown) for suppressing refrigerant discharged from the compressor 10 from flowing back into the compressor 10.

Referring to FIG. 1, the driving unit 120 according to the embodiment includes a stator 121 and a rotor 122. The stator 121 is fitted onto the inner circumferential surface of the cylindrical shell 111, and the rotor 122 is rotatably disposed in the stator 121.

The stator 121 includes a stator core 1211 and a stator coil 1212.

The stator core 1211 is formed in an annular shape or a hollow cylindrical shape and is shrink-fitted onto the inner circumferential surface of the cylindrical shell 111.

A rotor accommodating portion 1211*a* is formed in a circular shape through a central portion of the stator core 1211 such that the rotor 122 can be rotatably inserted therein. A plurality of stator-side return grooves 1211*b* may be recessed or cut out in a D-cut shape at an outer circumferential surface of the stator core 1211 along the axial direction and disposed at preset distances along a circumferential direction.

A plurality of teeth (not illustrated) and slots (not illustrated) are alternately formed on an inner circumferential surface of the rotor accommodating portion 1211*a* in the circumferential direction, and the stator coil 1212 is wound on each tooth by passing through the slots at both sides of the tooth.

More precisely, the slots may be spaces between circumferentially neighboring stator coils. In addition, the slot defines an inner passage 120*a*, an air gap passage is defined between the inner circumferential surface of the stator core 1211 and an outer circumferential surface of a rotor core 1221 to be described later, and an oil return groove 1211*b* defines an external passage. The inner passages 120*a* and the air gap passage define a passage through which refrigerant discharged from the compression part moves to the upper space S2, and the external passage defines a first oil return passage Po1 through which oil separated in the upper space S2 is returned to the oil storage space S11.

The stator coil 1212 is wound around the stator core 1211 and electrically connected to an external power source through a terminal (not illustrated) that is coupled through the casing 110. An insulator 1213, which is an insulating member, is inserted between the stator core 1211 and the stator coil 1212.

The insulator 1213 may be provided at an outer circumferential side and an inner circumferential side of the stator coil 1212 to accommodate a bundle of the stator coil 1212 in the radial direction, and may extend to both sides in the axial direction of the stator core 1211.

The rotor 122 includes a rotor core 1221 and permanent magnets 1222.

The rotor core 1221 is formed in a cylindrical shape to be accommodated in a rotor accommodating portion 1211*a* defined in the central portion of the stator core 1211.

Specifically, the rotor core 1221 is rotatably inserted into the rotor accommodating portion 1211*a* of the stator core 1211 with a predetermined gap 120*a* therebetween. The permanent magnets 1222 are embedded in the rotor core 1222 at preset distances along the circumferential direction.

A balance weight 123 may be coupled to a lower end of the rotor core 1221. Alternatively, the balance weight 123 may be coupled to a main shaft portion 1251 of the rotary shaft 125 to be described later. This embodiment of the present disclosure will be described based on an example in which the balance weight 123 is coupled to a lower end of the rotor core 1221.

In addition, the balance weight 123 is coupled to the lower end of the rotor core 1221 and rotates in response to rotation of the rotor 122.

A gas vent hole may be formed through the outer periphery of the balance weight 123 to relieve a pressure difference at the lower portion caused by the discharge hole 163 and to allow the refrigerant to flow upward.

The rotary shaft 125 is coupled to the center of the rotor core 1221. An upper end portion of the rotary shaft 125 is press-fitted to the rotor 122, and a lower end portion of the rotary shaft 125 is rotatably inserted into the main frame 130 to be supported in the radial direction.

An air gap or a winding gap through which discharge refrigerant can flow may be defined in the rotor 122.

The main frame 130 is provided with a main bearing 171 configured as a bush bearing to support the first bearing portion 1252 of the rotary shaft 125. Accordingly, a portion, which is inserted into the main frame 130, of the lower end portion of the rotary shaft 125 can smoothly rotate inside the main frame 130.

The rotary shaft 125 transfers the rotational force of the driving unit 120 to the orbiting scroll 150 constituting the compression unit. Accordingly, the orbiting scroll 150 eccentrically coupled to the rotary shaft 125 may perform an orbital motion with respect to the fixed scroll 140.

Referring to FIG. 1, the rotary shaft 125 according to the embodiment includes a main shaft portion 1251, a first bearing portion 1252, a fixed bearing portion 1253, and an eccentric portion 1254.

The main shaft portion 1251 is an upper portion of the rotary shaft 125 and formed in a cylindrical shape. The main shaft portion 1251 may be partially press-fitted to the stator core 1221.

The first bearing portion 1252 is a portion extending from a lower end of the main shaft portion 1251. The first bearing portion 1252 may be inserted into a main bearing hole 133*a* of the main frame 130 so as to be supported in the radial direction.

The fixed bearing portion 1253 indicates a lower portion of the rotary shaft 125. The fixed bearing portion 1253 may be inserted into a sub bearing hole 143*a* of the fixed scroll 140 so as to be supported in the radial direction. A central axis of the fixed bearing portion 1253 and a central axis of the first bearing portion 1252 may be aligned on the same line. That is, the first bearing portion 1252 and the fixed bearing portion 1253 may have the same central axis.

The eccentric portion 1254 is formed between a lower end of the first bearing portion 1252 and an upper end of the fixed bearing portion 1253. The eccentric portion 1254 may be inserted into a rotary shaft coupling portion 153 of the orbiting scroll 150 to be described later.

The eccentric portion 1254 may be eccentric with respect to the first bearing portion 1252 and the fixed bearing portion 1253 in the radial direction. That is, a central axis of the eccentric portion 1254 may be eccentric with respect to the central axis of the first bearing portion 1252 and the central axis of the fixed bearing portion 1253. Accordingly, when the rotary shaft 125 rotates, the orbiting scroll 150 can perform an orbiting motion with respect to the fixed scroll 140.

On the other hand, an oil supply passage 126 for supplying oil to the first bearing portion 1252, the fixed bearing portion 1253, and the eccentric portion 1254 may be formed in a hollow shape in the rotary shaft 125. The oil supply passage 126 may include an inner oil passage 1261 defined in the rotary shaft 125 along the axial direction.

As the compression unit is located below the driving unit 120, the inner oil passage 1261 may be formed in a grooving manner from the lower end of the rotary shaft 125 approximately to a lower end or a middle height of the stator 121 or up to a position higher than an upper end of the first bearing portion 1252. Although not illustrated, the inner oil passage 1261 may alternatively be formed through the rotary shaft 125 in the axial direction.

An oil pickup 127 for pumping up oil filled in the oil storage space S11 may be coupled to the lower end of the rotary shaft 125, namely, a lower end of the fixed bearing portion 1253. The oil pickup 127 may include an oil supply pipe 1271 inserted into the inner oil passage 1261 of the rotary shaft 125, and a blocking member 1272 accommodating the oil supply pipe 1271 to block an introduction of foreign materials. The oil feeding pipe 1271 may extend downward through the discharge cover 160 to be immersed in the oil filled in the oil storage space S11.

The rotary shaft 125 may be provided with a plurality of oil supply holes that communicate with the inner oil passage 1261 to guide oil moving upward along the inner oil passage 1261 to flow toward the first bearing portion 1252, the fixed bearing portion 1253, and the eccentric portion 1254.

Referring to FIG. 2, an example is shown in which the compression unit according to an embodiment of the present disclosure includes the main frame 130, the fixed scroll 140, the orbiting scroll 150, and the discharge cover 160.

The main frame 130 is fixedly disposed on an opposite side of the fixed scroll 140 with the orbiting scroll 150 interposed therebetween. In addition, the main frame 130 may accommodate the orbiting scroll 150 to perform the orbital motion.

Referring to FIGS. 1 and 2, the main frame 130 may include a frame end plate portion 131, a frame side wall portion 132, and a main bearing accommodating portion 133.

The frame end plate portion 131 is formed in an annular shape and disposed below the driving unit 120. The frame side wall portion 132 may extend in a cylindrical shape from a rim of a lower surface of the main frame 130. For example, the frame side wall portion 132 extends in a cylindrical shape from a rim of a lower surface of the frame end plate portion 131. An outer circumferential surface of the frame side wall portion 132 is fixed to an inner circumferential surface of the cylindrical shell 111 in a shrink-fitting manner or welding manner. Accordingly, the oil storage space S11 and the outflow space S12 constituting the lower space S1 of the casing 110 can be separated from each other by the frame end plate portion 131 and the frame side wall portion 132.

A second outflow hole 1321*a* defining a portion of an outflow passage is formed through the frame side wall portion 132 in the axial direction. The second outflow hole 132*a* may be formed to correspond to a first outflow hole 142*c* of the fixed scroll 140 to be described later, to define a refrigerant outflow passage together with the first outflow hole 142*c*.

As illustrated in FIGS. 6 and 2, the second outflow hole 132*a* may be elongated in the circumferential direction, or may be provided in plurality disposed at preset distances along the circumferential direction. Accordingly, the second outflow hole 132*a* can secure a volume of a compression chamber V relative to the same diameter of the main frame 130 by maintaining a minimum radial width with securing a discharge area. This may equally be applied to the first outflow hole 142*c* that is formed in the fixed scroll 140 to define a portion of the outflow passage.

An outflow guide groove 132*b* to accommodate the plurality of second outflow holes 132*a* may be formed in an upper end of the second outflow hole 132*a*, namely, an upper surface of the frame end plate portion 131. At least one outflow guide groove 132*b* may be formed according to the position of the second outflow hole 132*a*. For example, when the second outflow holes 132*a* form three groups, the number of discharge guide grooves 132*b* may be three to accommodate the three groups of second outflow holes 132*a*, respectively. The three outflow guide grooves 132*a* may be located on the same line in the circumferential direction.

The outflow guide groove 132*b* may be formed wider than the second outflow hole 132*a*. For example, the second outflow hole 132*a* may be formed on the same line in the circumferential direction together with a first oil return groove 132*c* to be described later. Therefore, when a flow path guide 190 to be described later is provided, the second outflow hole 132*a* having a small cross-sectional area may be difficult to be located at an inner side of the flow path guide 190. With this reason, the outflow guide groove 132*b* may be formed at an end portion of the second outflow hole 132*a* while an inner circumferential side of the outflow guide groove 132*b* extends radially up to the inner side of the flow path guide 190.

Accordingly, the second outflow hole 132*a* can be located adjacent to the outer circumferential surface of the frame 130 by reducing an inner diameter of the second outflow hole 132*a*, and simultaneously can be suppressed from being located at an outer side of the flow path guide 190, namely, adjacent to the outer circumferential surface of the stator 121 due to the flow path guide 190.

A first oil return groove 132*c* that defines a portion of a second oil return passage Po2 may be formed axially through an outer circumferential surface of the frame end plate portion 131 and an outer circumferential surface of the frame side wall portion 132 that define the outer circumferential surface of the main frame 130. The first oil return groove 132*c* may be provided by only one or may be provided in plurality disposed in the outer circumferential surface of the main frame 130 at preset distances in the circumferential direction. Accordingly, the outflow space S12 of the casing 110 can communicate with the oil storage space S11 of the casing 110 through the first oil return groove 132*c*.

The first oil return groove 132*c* may be formed to correspond to a second oil return groove (not shown) of the fixed scroll 140, which will be described later, and define the second oil return passage together with the second oil return groove of the fixed scroll 140.

The main bearing accommodating portion 133 protrudes upward from an upper surface of a central portion of the frame end plate portion 131 toward the driving unit 120. The main bearing accommodating portion 133 is provided with a main bearing hole 133*a* formed therethrough in a cylindrical shape along the axial direction. The first bearing portion 1252 of the rotary shaft 125 is inserted into the main bearing hole 133*a* to be supported in the radial direction.

Hereinafter, the fixed scroll 140 will be described with reference to FIGS. 1 and 2. The fixed scroll 140 according to the embodiment may include the fixed end plate portion 141, the fixed side wall portion 142, the sub bearing portion 143, and the fixed wrap 144.

The fixed end plate portion 141 may be formed in a disk shape having a plurality of concave portions on an outer circumferential surface thereof, and a sub bearing hole formed in the inner circumference of the sub bearing portion 143 to be described later may be formed through a center of the fixed end plate portion 141 in the vertical direction. A discharge port 1411 may be formed around the sub bearing hole. The discharge port 1411 may communicate with a discharge pressure chamber Vd so that compressed refrigerant is discharged into the outflow space S3 of the discharge cover 160 to be explained later.

Only one discharge port 1411 may be provided to communicate with both of a first compression chamber V1 and a second compression chamber V2 to be described later. In the embodiment, however, a first discharge port may communicate with the first compression chamber V1 and a second discharge port may communicate with the second compression chamber V2. Accordingly, refrigerants compressed in the first compression chamber V1 and refrigerant compressed in the second compression chamber V2 can be independently discharged through the different discharge ports.

The fixed side wall portion 142 may extend in an annular shape from an edge of an upper surface of the fixed end plate portion 141 in the vertical direction. The fixed side wall portion 142 may be coupled to face the frame side wall portion 132 of the main frame 130 in the vertical direction.

The first outflow hole 142*c* may be formed through the fixed side wall portion 142 in the axial direction. The first outflow hole 142*c* may be elongated in the circumferential direction or may be provided in plurality disposed at preset distances along the circumferential direction. Accordingly, the first outflow hole 142*c* can secure a volume of a compression chamber V relative to the same diameter of the fixed scroll 140 by maintaining a minimum radial width with securing a discharge area.

As described above, the check valve 145 is installed in the fixed scroll 140, and the check valve coupling portion 142*b* to which the check valve 145 is coupled may be disposed in the side portion of the fixed scroll 140.

For example, the check valve 145 may be coupled to the fixed side wall portion 142 of the fixed scroll 140, and for this purpose, the check valve coupling portion 142*b* may be formed on the fixed side wall portion 142.

The check valve coupling portion 142*b* may be formed differently depending on a coupling method between the fixed scroll 140 and the check valve 145.

For example, when the fixed scroll 140 and the check valve 145 are press-fitted to each other, the check valve coupling portion 142*b* may have a diameter of the outer diameter of the check valve 145 to be inserted, and an inner diameter allowing the check valve 145 to be press-fitted.

FIG. 3 illustrates an example in which the suction port 142*a* of the fixed scroll 140 and the valve fixing part 149 of the check valve 145 are screw-coupled to each other. In this case, the check valve coupling portion 142*b* disposed on the side portion of the fixed scroll 140 may be formed as a screw thread.

The check valve coupling portion 142*b* may be formed radially through the fixed side wall portion 142.

The valve fixing part 149 may be press-fitted or screw-coupled to the side surface (the check valve coupling portion 142*b*) forming the suction port 142*a* of the fixed scroll 140.

When the fixed scroll 140 and the check valve 145 are press-fitted to each other, the check valve coupling portion 142*b* may have a diameter of the outer diameter of the check valve 145 to be inserted, and an inner diameter allowing the check valve 145 to be press-fitted.

As illustrated in FIG. 3, when the fixed scroll 140 and the valve fixing part 149 of the check valve 145 are screw-coupled to each other, the check valve coupling portion 142*b* may have the screw thread on its inner circumference, and the screw thread of the check valve coupling portion 142*b* may be engaged with the screw thread of the valve fixing part 149.

Meanwhile, it is preferable that a check valve flow groove 148, in which the plate member 146*b* of the check valve is rotatable, is formed near a starting point of the compression chamber V.

The starting point of the compression chamber V may be the suction port 142*a* of the fixed scroll 140.

The check valve flow groove 148 may be formed substantially in a cylindrical shape. Accordingly, in the closed state, the plate member 146*b* is brought into contact with the rotation-limiting end portion 146*c* to close the inlet portion 146*d*, and in the open state, the plate member 146*b* is open by moving inside the compression chamber V until it is caught by the fixed wrap 144 of the fixed scroll 140.

Therefore, the check valve flow groove 148 is preferably formed from the suction port 142*a* on one side portion of the compression chamber V to another side portion of the compression chamber V along a path along which the plate member 146*b* rotates. A distance between the one side portion and the another side portion of the compression chamber V may be referred to as the width of the compression chamber V.

The check valve flow groove 148 may be formed in the side portion of the fixed scroll 140, and may also be formed in a direction in which the plate member 146*b* of the check valve 145 rotates.

In particular, the check valve flow groove 148 may be formed to extend radially inward toward the sub bearing portion 143 of the fixed scroll 140. The sub bearing portion 143 of the fixed scroll 140 rotatably supports the lowermost portion of the rotary shaft 125 through the bearing.

The compression chamber V is formed by the pair of fixed wrap 144 and orbiting wrap 152 facing each other, and this compression chamber V may be formed in an involute shape from the suction port 142*a* of the compression chamber V. That is, the compression chamber V may be formed in an involute shape radially from an outer side toward an inner side. Compression is performed while refrigerant flows from the radially outer side to the radially inner side along the compression chamber V. Therefore, pressure increases toward the radially inner side.

A starting portion 159 of the compression chamber V may be formed radially at the outermost side of the compression chamber V. Accordingly, refrigerant introduced through the suction port 142*a* flows counterclockwise along the compression chamber V, with reference to FIGS. 5 and 8.

At this time, refrigerant flowing in from the inside of the check valve 145 may be guided counterclockwise along a curve of the inner circumference of the compression chamber V by the open plate member 146*b*, thereby reducing flow resistance.

Due to the shape of the compression chamber V and the shape of the check valve flow groove 148, the opening and closing direction of the plate member 146*b* of the check valve is important.

The plate member 146*b* is open as illustrated in FIGS. 5 and 8, and closed as illustrated in FIG. 9. That is, it is preferable that the plate member 146*b* rotates horizontally and is open toward a downstream side of the compression chamber V.

Therefore, the rotating portion 146*a* of the plate member 146*b* is preferably located at a starting portion of the compression chamber V.

Since the rotating portion 146*a* of the plate member 146*b* is located at the starting portion of the compression chamber V, the flow of refrigerant introduced from the inlet portion 146*d* is guided by the plate member 146*b* in the open state of the plate member 146*b*.

The plurality of first outflow holes 142*c* illustrated are holes through which refrigerant compressed inside the compression chamber V and discharged to the outside of the compression chamber V passes upward.

Referring to FIG. 8, flow resistance according to the opening and closing of the plate member 146*b* of the check valve 145 near the suction port 142*a* will be described in detail.

As described above, the scroll compressor 10 is arranged vertically and the end portion of the refrigerant suction pipe 115 is arranged on the side portion of the fixed scroll 140. Additionally, the check valve 145 may also be installed on the side portion of the fixed scroll 140.

Accordingly, the plate member 146*b* can be open and closed horizontally, and for this purpose, the pin, which is the rotary shaft 125 of the plate member 146*b*, can be arranged in a vertical direction. That is, the plate member 146*b* of the check valve is open and closed horizontally on the side surface of the fixed scroll 140.

In addition, as illustrated in FIG. 8, a dead volume may be generated only for a volume less than a volume formed by the rotational trajectory of the plate member 146*b*, such that the plate member 146*b* is open and closed. That is, an extremely small amount of refrigerant reversely flows, which does not cause a reverse rotation of the orbiting scroll 150.

In particular, since the opening direction of the plate member 146*b* is toward the side wall portion of the fixed scroll 140, a compact structure can be implemented.

When the plate member 146*b* is open and refrigerant flows into the compression chamber V, the refrigerant that is introduced may be smoothly guided by hitting against the plate member 146*b* that is disposed at an angle.

That is, when the plate member 146*b* is open, the plate member 146*b* performs the function of guiding the introduction of refrigerant. Accordingly, in the case where there is not the plate member 146*b*, the flow of refrigerant is substantially vertically curved. To the contrary, in the case where the plate member 146*b* acts as a guide, refrigerant can flow in a streamlined diagonal shape, which can reduce flow path loss.

That is, in the open state, the plate member 146*b* can be arranged so that the inner surface faces the flowing direction of refrigerant within the compression chamber V, to guide the inflow of the refrigerant.

In FIG. 8, an example is shown in which the inner surface of the plate member 146*b* is arranged to face the direction of an arrow, thereby guiding the inflow of refrigerant.

The inner surface of the plate member 146*b* may be a surface that faces the inlet portion 146*d* of the check valve 145 and the refrigerant flow passage 146*e* when the plate member 146*b* is closed.

Meanwhile, when the operation of the orbiting scroll 150 stops, pressure in a space between the plate member 146*b* and the starting portion 159 of the compression chamber V becomes higher than internal pressure of the refrigerant suction pipe 115 and the check valve 145. Therefore, pressure by which the plate member 146*b* is closed can be generated at the starting portion of the compression chamber V, and thus the plate member 146*b* can be closed immediately. When the plate member 146*b* is closed, the flow of refrigerant flowing clockwise can be smoothly stopped along a curved surface at the starting point of the compression chamber V.

In particular, a flow path width at the starting point of the compression chamber V is preferably smaller than a width of the compression chamber V at other portions. That is, in the compression chamber V corresponding to an outer diameter of the check valve flow groove 148, the width of the passage may gradually increase from the starting point of the compression chamber V toward the center of the compression chamber V along the circumferential direction.

Therefore, the reduction in the width of the passage at the starting point of the compression chamber V can more facilitate the forward flow of refrigerant while more effectively stopping the reverse flow of the refrigerant.

Therefore, a merely small dead volume occurs, which can result in effectively suppressing the reverse turn of the orbiting scroll 150.

Additionally, noise can be greatly reduced by installing the check valve in a refrigerant inlet side rather than a refrigerant discharge side.

Meanwhile, the check valve 145 may be installed in the check valve coupling portion 142*b* of the fixed side wall portion 142 of the fixed scroll 140, and the refrigerant suction pipe 115 can communicate with the check valve 145. In addition, the inlet tube 147*a* is coupled to the inlet coupling portion 149*f* of the check valve 145, and the refrigerant suction pipe is coupled to the inlet tube 147*a*.

The first outflow hole 142*c* communicates with the second outflow hole 132*a* in the state in which the fixed scroll 140 is coupled to the cylindrical shell 111. Accordingly, the first outflow hole 142*c* can define a refrigerant outflow passage together with the second outflow hole 132*a*.

A second oil return groove may be formed in an outer circumferential surface of the fixed side wall portion 142. The second oil return groove communicates with the first oil return groove 132*c* provided in the main frame 130 to guide oil returned along the first oil return groove 132*c* toward the oil storage space S11. Accordingly, the first oil return groove 132*c* and the second oil return groove define the second oil return passage Po2 together with an oil return groove 1612*a* of the discharge cover 160 to be described later.

The fixed side wall portion 142 is provided with a suction port 142*a* formed through the fixed side wall portion 142 in the radial direction. An end portion of the refrigerant suction pipe 115 inserted through the cylindrical shell 111 is inserted into the suction port 142*a*. Accordingly, refrigerant can be introduced into a compression chamber V through the refrigerant suction pipe 115.

The sub bearing portion 143 extends in the axial direction from a central portion of the fixed end plate portion 141 toward the discharge cover 160. A sub bearing hole 1431 having a cylindrical shape may be formed through a center of the sub bearing portion 143 in the axial direction, and the fixed bearing portion 1253 of the rotary shaft 125 may be inserted into the sub bearing hole 1431 to be supported in the radial direction. Therefore, the lower end (or the fixed bearing portion) of the rotary shaft 125 can be radially supported by being inserted into the sub bearing portion 143 of the fixed scroll 140, and the eccentric portion 1254 of the rotary shaft 125 can be supported in the axial direction by an upper surface of the fixed end plate portion 141 defining a periphery of the sub bearing portion 143.

The fixed wrap 144 may extend from the upper surface of the fixed end plate portion 141 toward the orbiting scroll 150 in the axial direction. The fixed wrap 144 is engaged with an orbiting wrap 152 to be described later to define the compression chamber V. The fixed wrap 144 will be described later together with the orbiting wrap 152.

Hereinafter, the orbiting scroll 150 will be described with reference to FIGS. 1 and 2. Specifically, the orbiting scroll 150 according to this embodiment may include an orbiting end plate portion 151, an orbiting wrap 152, and a rotary shaft coupling portion 153.

The orbiting end plate portion 151 is formed in a disk shape and accommodated in the main frame 130. An upper surface of the orbiting end plate portion 151 may be supported in the axial direction by the main frame 130 with interposing a back pressure sealing member (no reference numeral given) therebetween.

The orbiting wrap 152 may extend from a lower surface of the orbiting end plate portion 151 toward the fixed scroll 140. The orbiting wrap 152 is engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape.

For example, the orbiting wrap 152 may be formed in a substantially elliptical shape in which a plurality of arcs having different diameters and origins are connected and the outermost curve may have a major axis and a minor axis. The fixed wrap 144 may also be formed in a similar manner.

An inner end portion of the orbiting wrap 152 may be formed at a central portion of the orbiting end plate portion 151, and the rotary shaft coupling portion 153 may be formed through the central portion of the orbiting end plate portion 151 in the axial direction.

The eccentric portion 1254 of the rotary shaft 125 is rotatably inserted into the rotary shaft coupling portion 153. An outer circumferential part of the rotary shaft coupling portion 153 is connected to the orbiting wrap 152 to define the compression chamber V together with the fixed wrap 144 during a compression process.

The rotary shaft coupling portion 153 may be formed at a height at which it overlaps the orbiting wrap 152 on the same plane. That is, the rotary shaft coupling portion 153 may be disposed at a height at which the eccentric portion 1254 of the rotary shaft 125 overlaps the orbiting wrap 152 on the same plane. Accordingly, repulsive force and compressive force of refrigerant can cancel each other while being applied to the same plane based on the orbiting end plate portion 151, and thus inclination of the orbiting scroll 150 due to interaction between the compressive force and the repulsive force can be suppressed.

The rotary shaft coupling portion 153 may include a coupling side portion (not illustrated) that is in contact with an outer circumference of an orbiting bearing 173 to support the orbiting bearing 173.

In addition, the rotary shaft coupling portion 153 may further include a coupling end portion (not illustrated) that is in contact with one end of the orbiting bearing 173 to support the orbiting bearing 173.

The coupling side portion is formed on an inner circumference of the rotary shaft coupling portion 153 to come in contact with an outer circumference of the orbiting bearing 173, and the coupling end portion is in contact with the upper end of the orbiting bearing 173 to support the orbiting bearing 173.

On the other hand, the compression chamber V is formed in a space defined by the fixed end plate portion 141, the fixed wrap 144, the orbiting end plate portion 151, and the orbiting wrap 152. The compression chamber V may include a first compression chamber V1 defined between an inner surface of the fixed wrap 144 and an outer surface of the orbiting wrap 152, and a second compression chamber V2 defined between an outer surface of the fixed wrap 144 and an inner surface of the orbiting wrap 152.

The scroll compressor 10 according to the embodiment may operate as follows.

That is, when power is applied to the driving motor 120, rotational force is generated and the rotor 122 and the rotary shaft 125 rotates accordingly. As the rotary shaft 125 rotates, the orbiting scroll 180 eccentrically coupled to the rotary shaft 125 performs an orbiting motion relative to the fixed scroll 140 by the Oldham ring 170.

Accordingly, a volume of a compression chamber V decreases gradually along a suction pressure chamber Vs defined at an outer side of the compression chamber V, an intermediate pressure chamber Vm continuously formed toward a center, and a discharge pressure chamber Vd defined in a central portion.

Then, refrigerant moves to the accumulator (not illustrated) sequentially via a condenser (not illustrated), an expander (not illustrated), and an evaporator 50 of a refrigeration cycle. The refrigerant then flows toward the suction pressure chamber Vs forming the compression chamber V through the refrigerant suction pipe 115.

At this time, the plate member 146*b* of the check valve 145 is spaced apart from the rotation-limiting end portion 146*c* by the rotation of the rotating portion 146*a* and thereby open. The refrigerant flowing through the refrigerant suction pipe 115 is guided into the compression chamber V by the open plate member 146*b* of the check valve 145. The refrigerant suctioned into the suction pressure chamber Vs is then compressed while moving toward the discharge pressure chamber Vd via the intermediate pressure chamber Vm along the movement trajectory of the compression chamber V. The compressed refrigerant is discharged from the discharge pressure chamber Vd to the outflow space S3 of the discharge cover 160 through the discharge port 1411.

Then, the refrigerant discharged to the discharge space S12 of the discharge cover 160 may be mixed refrigerant with oil. However, mixed refrigerant or refrigerant in the description moves to the outflow space S12 defined between the main frame 130 and the driving motor 120 through the outflow hole accommodating groove 1613 of the discharge cover 160 and the first outflow hole 142*c* of the fixed scroll 140. The mixed refrigerant passes through the driving motor 120 to move to the upper space S2 of the casing 110 defined above the driving motor 120.

The mixed refrigerant moved to the upper space S2 is separated into refrigerant and oil in the upper space S2. The refrigerant (or some mixed refrigerant from which oil is not separated) flows out of the casing 110 through the refrigerant discharge pipe 116 so as to move to the condenser of the refrigeration cycle.

On the other hand, the oil separated from the refrigerant in the upper space S2 (or mixed oil with liquid refrigerant) moves to the lower space S1 along the first oil return passage Po1 between the inner circumferential surface of the casing 110 and the stator 121. The oil moved to the lower space S1 is returned to the oil storage space S11 defined in the lower portion of the compression part along the second oil return passage Po2 between the inner circumferential surface of the casing 10 and the outer circumferential surface of the compression part.

This oil is thusly supplied to each bearing surface (not illustrated) through the oil feeding passage 126, and partially supplied into the compression chamber V. The oil supplied to the bearing surfaces and the compression chamber V is discharged to the discharge cover 160 together with refrigerant and then returned. This series of processes is repeatedly performed.

Meanwhile, when the compressor is stopped, pressure inside the compression chamber V becomes relatively high, and pressure of the check valve 145 and the refrigerant suction pipe 115 becomes relatively low, so that the plate member 146*b* comes into contact with the rotation-limiting end portion 146*c* so as to be closed.

This suppresses backflow of the refrigerant from the compression chamber V to the refrigerant suction pipe 115.

The aforementioned scroll compressor 10 is not limited to the configuration and the method of the embodiments described above, but the embodiments may be configured such that all or some of the embodiments are selectively combined so that various modifications can be made.

It will be apparent to those skilled in the art that the present disclosure may be embodied in other specific forms without departing from the spirit or essential characteristics thereof. The above detailed description should not be limitedly construed in all aspects and should be considered as illustrative. Therefore, all changes and modifications that fall within the metes and bounds of the claims, or equivalents of such metes and bounds are therefore intended to be embraced by the appended claims.

INDUSTRIAL APPLICABILITY

The present disclosure may be applied to a scroll compressor.

The invention claimed is:

1. A scroll compressor, comprising:

a casing that defines an appearance thereof;

a driving unit that is installed inside of the casing to generate a drive force;

a rotary shaft that is rotatably installed in the driving unit;

a compression unit that comprises an orbiting scroll installed on the rotary shaft to perform an orbital motion, and a fixed scroll engaged with the orbiting scroll to form a compression chamber together with the orbiting scroll; and a check valve that comprises a valve part having one side disposed to face the compression chamber to guide suction of refrigerant when being open and suppress backflow of refrigerant by being closed when an operation of the compressor is stopped, and a valve fixing part installed through a side surface disposed on a suction port of the fixed scroll, wherein the valve fixing part is screw-coupled to the side surface disposed on the suction port of the fixed scroll, and wherein the valve fixing part comprises a screw portion formed to extend spirally in a circumferential direction, and a screw coupling portion is formed on the side surface disposed on the suction port of the fixed scroll and has a screw thread extending in a spiral shape to be screw-coupled with the screw portion.

2. A scroll compressor, comprising:

a casing that defines an appearance thereof;

a driving unit that is installed inside of the casing to generate a drive force;

a rotary shaft that is rotatably installed in the driving unit;

a compression unit that comprises an orbiting scroll installed on the rotary shaft to perform an orbital motion, and a fixed scroll engaged with the orbiting scroll to form a compression chamber together with the orbiting scroll; and a check valve that comprises a valve part having one side disposed to face the compression chamber to guide suction of refrigerant when being open and suppress backflow of refrigerant by being closed when an operation of the compressor is stopped, and a valve fixing part installed through a side surface disposed on a suction port of the fixed scroll, wherein the valve part comprises:

a valve body having one side inserted into the valve fixing part and comprising a refrigerant flow passage through which refrigerant flows; and a plate member having a rotating portion on one side adjacent to the compression chamber to be rotatably connected to the valve body, the plate member being open when refrigerant is introduced and closed when the operation of the compressor is stopped to suppress the backflow of the refrigerant.

3. The scroll compressor of claim 2, wherein the valve body comprises a rotation-limiting end portion that is disposed on one surface facing the compression chamber and supports the plate member while limiting rotation of the plate member in one direction to suppress the backflow of the refrigerant.

4. The scroll compressor of claim 2, wherein the plate member is disposed, in the open state, such that an inner surface thereof is disposed to face a flowing direction of refrigerant in the compression chamber, to guide an introduction of the refrigerant into the compression chamber.

5. The scroll compressor of claim 4, wherein a plate member receiving groove is formed in the suction port of the fixed scroll to rotatably receive the plate member, and wherein the plate member receiving groove is formed from one side portion of the compression chamber to another side portion of the compression chamber along a path along which the plate member rotates.

6. The scroll compressor of claim 4, wherein the valve body comprises an opening direction maintenance portion formed by cutting one side of an outer circumference into a D-cut shape to maintain an opening direction of the plate member, and wherein a guide groove is formed in a side portion of the fixed scroll to be engaged with the opening direction maintenance portion to maintain the opening direction of the plate member.

7. The scroll compressor of claim 2, wherein the valve body comprises a protruding coupling end portion that protrudes toward the valve fixing part from an opposite end of the valve part, and wherein the valve fixing part comprises a coupling groove disposed in an inner circumference of an end portion facing the valve body such that the protruding coupling end portion is inserted and received.

8. The scroll compressor of claim 1, wherein the valve fixing part is press-fitted to the side surface disposed on the suction port of the fixed scroll.

9. The scroll compressor of claim 1, wherein an inlet coupling portion is disposed in an inner circumference of an opposite side of the valve fixing part to the valve part, such that an inlet tube is installed therein.

10. The scroll compressor of claim 9, wherein the inlet coupling portion is formed such that an inner circumference thereof has a polygonal structure for fixing the inlet tube.

11. The scroll compressor of claim 1, wherein the valve fixing part further comprises a sealing portion connected to the screw portion and disposed on an outer circumference of an opposite side to the valve part.

12. The scroll compressor of claim 11, wherein the sealing portion protrudes radially more than the screw portion, and wherein the valve fixing part comprises an inlet coupling portion disposed in an inner circumference of an opposite side thereof to where the valve part is disposed, such that an inlet tube is installed, and a collar coupling portion formed more inward than the inlet coupling portion to form a step, such that a collar member is installed to be fitted to an inner circumference of the inlet tube.

* * * * *